US006394447B1

(12) United States Patent
Kawai et al.

(10) Patent No.: US 6,394,447 B1
(45) Date of Patent: May 28, 2002

(54) SHEET INVERSION DEVICE

(75) Inventors: Norikazu Kawai; Takeshi Kakinuma; Koji Kirino; Takahiro Ono, all of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/662,815

(22) Filed: Sep. 15, 2000

(30) Foreign Application Priority Data

Sep. 17, 1999 (JP) ..... 11-263764
Sep. 20, 1999 (JP) ..... 11-265470

(51) Int. Cl.[7] ..... B63H 29/00
(52) U.S. Cl. ..... 271/186; 271/185
(58) Field of Search ..... 271/184, 185, 271/186

(56) References Cited

U.S. PATENT DOCUMENTS 3,337,213 A * 8/1967 Barre ..... 271/184
4,262,895 A * 4/1981 Wenthe ..... 271/184
4,346,880 A * 8/1982 Roller et al. ..... 271/186
4,359,217 A * 11/1982 Roller et al. ..... 271/186
5,106,075 A * 4/1992 Wafford et al. ..... 271/186
5,449,164 A * 9/1995 Quesnel et al. ..... 271/186
5,720,478 A * 2/1998 Carter et al. ..... 271/186

FOREIGN PATENT DOCUMENTS

JP 404246055 A * 9/1992 ..... 271/186
JP 7-232848 9/1995

* cited by examiner

*Primary Examiner*—H. Grant Skaggs
(74) *Attorney, Agent, or Firm*—Foley & Lardner

(57) ABSTRACT

A sheet inversion device for inverting a sheet that is fed in and for feeding out the inverted sheet has intermediate rollers, feed-in rollers, feed-out rollers, inversion rollers, and pressing guide members. The feed-in rollers are positioned on one side of the intermediate rollers to feed a sheet. The feed-out rollers are located on the other side of the intermediate rollers to feed the sheet. The inversion rollers are located to the rear in the feed-in direction upon the receipt of the force produced by the advance of a sheet slip across the sheet while rotating in the feed-out direction. The pressing guide members exert, with the inversion rollers, a sheet pressing force to counter the force transmitted by the sheet. In the sheet inversion device, the pressing faces of the pressing guide members have the same arced shape as have the outer circumferential faces of the inversion rollers.

3 Claims, 25 Drawing Sheets

SHEET INVERSION DEVICE

BACKGROUND OF THE INVENTION

1. Field of the Invention

The present invention relates to a sheet inversion device provided in a copier that requires the alignment of pages in a multiple-copy process or the inversion of a sheet in double-side printing.

2. Description of the Related Art

A general example of this type of sheet inversion device is disclosed, for example, in Japanese Unexamined Patent Publication No. Hei 7-232848. In the inversion structure shown in FIG. 24, a feed-in roller 242 and a feed-out roller 243 both contact the circumferential outer surface of a clockwise rotating intermediate roller 241. When a sheet 244, sandwiched between the intermediate roller 241 and the feed-in roller 242, is delivered, the sheet 244 is fed along a guide plate 245 after being deflected obliquely upward by an opposed belt 246, and defines an inclined inversion path 247 between the guide plate 245 and the opposed belt 246.

When the trailing end of the sheet 244 is removed from between the intermediate roller 241 and the feed-in roller 242, gravity causes the trailing end (lower end) of the sheet 244 to hang downward in the drawing. At this time, while the opposite belt 246 is rotated counterclockwise, the trailing end (lower end) of the sheet 244 is guided to and grasped by the intermediate roller 241 and the feed-out roller 243, and is fed in the opposite direction.

However, because the conventional structure depends on gravity to shift sheets 244 introduced, along the inclined inversion path 247, from the feed-in direction, and to position them for pickup and removal by the intermediate roller 241 and the feed-out roller 243, the shifting of the sheets 244 for pickup by the intermediate roller 241 the feed-out roller 243 is not precisely performed and feeding failures occur.

Therefore, a sheet inversion device has been provided, wherein an inversion roller, which is rotated in the direction opposite to the sheet feed-in direction, and a pressing guide member, which applies a feed-in load to a sheet, are provided inside the inversion path, so that the inversion of the sheet does not depend on gravity.

However, in this case, since the inversion roller is rotated in the direction opposite to the sheet feed-in direction, the inversion roller applies the delivery force to the sheet in the opposite direction. As a result, if a sheet is thin, the leading edge of the sheet is bent or compressed when a strong holding pressure is applied by the inversion roller and the pressing guide member. And if a sheet is thick, a weak holding pressure applied by the inversion roller and the pressing guide member will not hold the sheet securely, and when the sheet is conveyed upward, its own weight may cause it to fall.

Additionally, for this device, while the sheet 244 is inverted, i.e., when the sheet 244 is released from the rollers 241 and 242 and before it is again sandwiched between the rollers 242 and 243, the sheet 244 is free. Therefore, when the free sheet 244 drops of its own weight, while the feeding force of the belt 246 acts on it, the sheet 244 is skewed and is obliquely discharged. When stapling is required in the following process, sheets discharged in the skewed state would be stapled. To prevent this, the discharged sheets must be manually aligned, and when double-side copying is performed, images will be copied onto sheets that are skewed during the inversion process, so that the copying performance is deteriorated.

SUMMARY OF THE INVENTION

Since a large inertial feeding force is produced when a sandwiched sheet is linearly fed, and since the leading edge of a sheet tends bend when it contacts another member, it is an object of the present invention to provide a sheet inversion device that includes a retraction structure that can eliminate an overload applied to the leading edge of a sheet, so that the sheet can be smoothly inverted, regardless of its thickness.

It is another object of the present invention to provide a sheet inversion device that does not skew sheets, even when the sheets are free and feeding force is applied, and that can align sheets as they are discharged.

According to a first aspect of the present invention, a sheet inversion device for reversing the surfaces of a sheet that has been fed into said sheet inversion device, comprises:

- a first roller, located at the start of an inversion path in the direction in which a sheet is input or output along said inversion path, that rotates in only one direction;
- a second roller, arranged parallel to said first rollers, that rotates with said first roller so as to feed said sheet into said inversion path;
- a third roller, located in parallel to said first rollers on the opposite side of said first rollers from said second rollers, that rotates with said first rollers to feed out and discharge said sheet from said inversion path;
- a fourth roller, located inside said inversion path, for applying a feeding force, in a discharge direction relative to a sheet feeding force applied by said first and second rollers, that causes said fourth rollers to slip across said sheet; and
- a pressing and guide member, for applying, with said fourth roller, a sheet pressing force that resists the advance of a sheet that is being fed;
- wherein a pressing face of said pressing and guide member has the same arced shape as has the circumferential outer face of said fourth roller.

According to a second aspect of the present invention, in addition to the arrangement of the first aspect, said pressing guide member comprises a first member for applying a pressing force and a second member having the same shape as the outer circumferential face of said fourth roller; and wherein said second member is permitted to pivot in the feeding direction at a fulcrum position whereat said second member is supported by said first member.

According to a third aspect of the present invention, in addition to the arrangement of the second aspect, an intermediate portion of said second member is located at said fulcrum position, and an elastic member for adjusting a pivoting distance is employed to couple together said first member and the rear portion of said second member.

According to a fourth aspect of the present invention, a sheet inversion device for reversing the surfaces of a sheet that has been fed into said sheet inversion device, comprises:

- a first roller, located at the start of an inversion path in the direction in which a sheet is input or output along said inversion path, that rotates in only one direction;
- a second roller, arranged parallel to said first rollers, that rotate with said first roller so as to feed said sheet into said inversion path;
- a third roller, located in parallel to said first rollers on the opposite side of said first rollers from said second rollers, that rotates with said first rollers to feed out and discharge said sheet from said inversion path;
- a fourth roller, located inside said inversion path, for applying a feeding force, in a discharge direction relative to a sheet feeding force applied by said first and second rollers, that causes said fourth rollers to slip across said sheet; and urging means for pushing said pressing guide member against said fourth roller upon the application of a force by said pivoting lever.

According to a fifth aspect of the present invention, sheet inversion device for reversing the surfaces of a sheet hat has been fed into said inversion device, comprises:

a first roller, located at the start of an inversion path in the direction in which a sheet is input or output along said inversion path, that rotates in only one direction;

a second roller, arranged parallel to said first rollers, that rotate with said first roller so as to feed said sheet into said inversion path;

a third roller, located in parallel to said first rollers on the opposite side of said first rollers from said second rollers, that rotates with said first rollers to feed out and discharge said sheet from said inversion path;

a fourth roller, located inside said inversion path, for applying a feeding force, in a discharge direction relative to a sheet feeding force applied by said first and second rollers, that causes said fourth rollers to slip across said sheet;

a rotary member, which is coaxially arranged with the rotary shaft of said fourth roller and which has a contact face that covers a part of said fourth roller, that is rotated and retracted when a driving force applied to a sheet being fed in is applied in turn to said rotary member as the leading edge of said sheet being fed in is pressed against said contact face; and a pressing guide member for which, when rotation of said rotary member is halted, controls the position of said rotary member so as to suppress the pressing force exerted against said fourth roller, and for which, when said rotary member rotates and retracts, said position control is canceled so that the pressing force can be exerted with that of said fourth roller.

According to a sixth aspect of the present invention, in addition to the arrangement of one of the first to fourth aspects of the present invention, said pressing guide member includes an elastic retraction control member for, when a thin sheet is being fed in by said first and said second said rollers, retracting upon the application of a force produced by the advance of said thin sheet, and for, when a thick sheet is being fed in by said first and said second rollers, retracting upon the application of a force produced by the advance of said thick sheet, while increasing the power of an elastic support force in accordance with the thickness of said sheet.

According to the present invention, for sheet inversion, a sheet, introduced to and sandwiched between the first and the second rollers at the beginning of the inversion path, is fed into the inversion path, and its leading edge is advanced to and inserted between the fourth roller and the pressing guide member. At this time, the sheet is being fed along the inversion path while the pressing guide member applies a pressing force to counter the force exerted to advance the sheet. Then, when the trailing edge of the sheet is freed from the clasp of the first and the second rollers, and the entire sheet has been fed into the inversion path, a feeding force exerted in the opposite direction by the fourth roller is applied to the sheet, which is thereafter delivered in the feed-out direction to the first and the third rollers. In this fashion, the sheet is inverted and is discharged from the inversion path.

In this case, since the pressing face of the pressing guide member has the same arced shape as has the circumferential outer face of the fourth roller, when a thin, comparatively weak sheet is introduced into the inversion path, as it is fed in its leading edge slides along the arc shaped face of the guide member and the circumferential outer face of the fourth roller. Thus, the deflection of the pressing guide member is small, and an appropriate pressing force is applied to the thin sheet.

On the other hand, since in the feed-in direction a strong linear force is projected by a thick, heavy sheet as it is fed into the inversion path, and its leading edge pushes down and thereby increases the displacement of the pressing guide member and the strength of the pressing reaction force, a satisfactorily strong pressing force can be obtained for the thick sheet. As a result, it is possible to provide a variable pressing force that is exerted in consonance with the thickness of a sheet, so that a thin sheet is prevented from being bent or from being compressed, and a thick sheet can be securely held and smoothly inverted.

Furthermore, when the pressing guide member is divided into a first member that exerts a pressing force and a second member that is shaped to fit the circumferential outer face of the fourth roller, and when the second member is provided so that it can pivot like a teeter-tooter in the feeding direction at the fulcrum point, whereat it is supported by the first member, the second member is pivoted by the application of the force produced by the advancement of the sheet, and consequently, its leading edge is retracted, separated from the opposite fourth roller, and its rear end is pushed against the sheet. Therefore, during the process performed to feed the sheet past the fourth roller, at which time the greatest load is supposed to be imposed on the sheet, when the leading edge of the sheet passes the fourth roller, the rear end of the second member is pushed against the sheet, so that no load is imposed on the leading edge of the sheet, and a stable feeding operation can be performed without the sheet being bent or deformed.

In addition, in a case wherein the intermediate portion of the second member is provided at the fulcrum, and wherein an elastic member for adjusting the pivoting distance is employed to connect the rear end of the second member to the first member, when a thin sheet is fed in, the elastic member that elastically supports the second member comparatively weakly operates the pressing guide member and permits it to pivot, so that the thin sheet is appropriately pressed against and guided. Then, when a thick sheet is fed in, the first member performs the original guiding operation so as to appropriately press against and guide the thick sheet. As a result, a broad application range extending from a thin sheet to a thick sheet can be obtained for the sheet passing process.

Furthermore, in the case wherein there is provided a pivoting lever, which pivots and retracts upon the application of force produced by the advance of the sheet that is fed in by the first roller and the second roller, and an urging means for pushing the pressing guide member, upon the application of the pivoting force produced by the pivoting lever, an interlocking structure can be obtained. That is, the movement of the pivoting lever is interlocked with the advance of the sheet that is fed in along the inversion path, and in consonance with this movement, the urging means pushes the pressing guide member against the fourth roller. Therefore, as a thin sheet is fed in, a weak force is generated by the advance of the thin sheet and a small pressing force is exerted, while as a thick sheet is fed in, a strong force is generated by the advance of the thick sheet and a large pressing force is exerted. As a result, an appropriate pressing force can be automatically obtained in consonance with the thickness of a sheet that is handled.

Moreover, assume that in the above case there were provided a rotary member, positioned coaxially with the rotary shaft of the fourth roller, that could cover a part of the fourth roller and that had a contact face that would contact the leading edge of a sheet, so that the force produced by the advance of the sheet would rotate and retract the rotary member; and there were provided a pressing guide member that, when the rotation of the rotary member was halted, could adjust the position of the rotary member so as to suppress the pressing force exerted by the fourth roller, and that, when the rotary member was rotated and retracted, canceled the positional relationship with the rotary member and permitted a pressing force to be exerted by the fourth roller. In this case, the leading edge of a sheet that is fed in along the inversion path contacts the contact face of the rotary member but does not contact the fourth roller that is rotating in the feed-out direction. Thus, when the sheet is fed in, a load in the feed-out direction is not imposed by the fourth roller, and the sheet is fed smoothly. Thereafter, when the leading edge of the sheet pushes the rotary member away and passes the fourth roller, the rotary member rotates and retracts and clears the outer circumferential surface of the fourth roller. The sheet then receives the feed-out force through its contact with the outer circumferential face of the fourth roller, and when the application of the feed-in force is halted, the sheet is fed in reverse in the feed-out direction.

Also, assume that in the above case the pressing guide member that includes the elastic retraction control member is provided, and that when a thin sheet is fed in by the first and the second rollers, the pressing guide member is simply retracted upon the application of the force produced by the advance of the thin sheet, while when a thick sheet is fed in, the pressing guide member is retracted upon the application of the force produced by the advance of the thick sheet and the strength of the elastic support force is increased in consonance with the thickness of the sheet. In this case, when the thin sheet is fed in, the pressing guide member performs an ordinary pressing operation and appropriately presses and guides the thin sheet, and when the thick sheet is fed in, the elastic retraction control member increases the elastic support force of the pressing guide member and appropriately supports the thick sheet. As a result, an appropriate pressing force can be exerted in consonance with the weights of a thin sheet and a thick sheet.

According to a seventh aspect of the invention, a sheet inversion device for inverting a sheet and discharging the inverted sheet, comprises:

first rollers, located at the start of an inversion path in the direction in which a sheet is input or output along the inversion path, that rotate in only one direction;

second rollers, arranged parallel to the first rollers, that rotate with the first rollers so as to sandwich the sheet between them and to feed the sheet into the inversion path;

third rollers, located in parallel to the first rollers on the opposite side of the first rollers from the second rollers, that rotate with the first rollers to feed out and discharge the sheet from the inversion path;

fourth rollers, located inside the inversion path, for exerting a feeding force, in a discharge direction relative to a sheet feeding force exerted by the first and second rollers, that causes the fourth rollers to slip across the sheet; and sheet control plates, located inside the inversion path, for holding the sheet at a predetermined position along the inversion path.

According to an eighth aspect of the invention, in addition to the arrangement of the seventh aspect, the sheet control plates are provided as pairs on both sides in consonance with the width of a sheet. In accordance with the positioning shift of the sheet that is delivered into the inversion path, the individual sheet control plates are moved horizontally, and are thereafter urged by urging means to return the sheet control plates to predetermined positions when the sheet is discharged.

According to a ninth aspect of the invention, in addition to the arrangement of the seventh aspect, the pairs of the sheet control plates are coupled in accordance with the width of the sheet, and are supported so as to be horizontally movable in consonance with the positioning shift of the sheet that is fed into the inversion path.

According to a tenth aspect of the invention, in addition to the arrangement of the ninth aspect, the sheet control plates are urged by the urging means so that the sheet control plates are returned to predetermined positions when the sheet is discharged.

According to an eleventh aspect of the invention, in addition to the arrangement of the seventh aspect, the pairs of the sheet control plates are provided in consonance with different sheet widths. The pairs of the sheet control plates are rotatably supported, so that when a sheet advances onto the corresponding pair of the sheet control plates, the pair of the sheet control plates are retracted.

According to a twelfth aspect of the invention, in addition to the arrangement of the seventh aspect, pairs of the sheet control plates are provided in a rib-shaped arrangement in accordance with different sheet widths. As a pair of the sheet control plates is positioned outward, the pair is higher than the other pair, which is positioned inward.

According to a thirteenth aspect of the invention, in addition to the arrangement of the seventh aspect, pairs of the sheet control plates are fitted around a rotary shaft at different angles in consonance with different sheet widths. As the rotary shaft is rotated, a specific pair of the sheet control plates can be selected in consonance with the width of a sheet that is fed into the inversion path.

According to a fourteenth aspect of the invention, in addition to the arrangement of the thirteenth aspect, a drive force is transmitted to the rotary shaft from a rotary shaft of the first rollers, which rotate in only one direction, via a unidirectional clutch, to which the reverse rotation of the first rollers is transmitted.

According to a fifteenth aspect of the invention, in addition to the arrangement of one of the seventh to the fourteenth aspects, each of the sheet control plates at the start of the inversion path is extended outward from the width of a corresponding sheet.

According to this invention, a sheet that is fed into the inversion path can be controlled at a predetermined position by using the sheet control plates. Thus, even when the sheet is released from the feeding rollers and is free of any feeding force, or when the feeding force in the discharge direction is applied to the free sheet by the rollers, the position of sheet that is discharged is controlled by the sheet control plates, so that skewing of the sheet is exactly prevented.

According to the eighth aspect, the sheet control plates can be individually moved and returned to their predetermined positions. Therefore, when the position of a sheet is shifted during feeding, or when the sheet is skewed due to a feeding failure, such a sheet can be accepted, and can also be returned to a predetermined position by the urging force. Thus, a sheet can be aligned at predetermined position, and can be discharged after its posture has been corrected.

According to the ninth aspect, since the pair of sheet control plates can be supported so that they can be moved horizontally, the sheet control plates can be moved and can cope with a sheet that is fed in while its position is shifted. The positioning of the sheet can be controlled when the sheet is accepted, and thereafter the sheet can be discharged.

According to the tenth aspect of the invention, the pairs of sheet control plates that are moved horizontally are urged to return to their predetermined positions, so that a sheet can be discharged from the center position.

According to the eleventh aspect of the invention, the sheet control plates are rotatably supported so that they can be retracted from the inversion path. In the process for the inversion of multiple sheets having different widths, when a wide sheet is fed in and runs across sheet control plates that correspond to a narrow sheet, these sheet control plates are retracted from the inversion path, so that the wide sheet can be precisely controlled by the corresponding sheet control plates. Therefore, when multiple types of sheets are employed, these can be precisely controlled,at corresponding locations.

According to the twelfth aspect, as the pair of sheet control plates in a rib-shaped arrangement is located outward, the height of the pertinent pair is increased. Therefore, as well as in the fifth aspect, when multiple sheets having various widths are employed, a wide sheet can runs across to the sheet control plates that correspond to a narrow sheet, and can be precisely controlled by the corresponding sheet control plates. As a result, even when a plurality of sheet type are employed, the positioning of all the sheets can be exactly controlled.

According to the thirteenth aspect of the invention, the sheet control plates are fitted around the rotary shaft in consonance with various sheet sizes, and appropriate plates are selected to control a sheet. Therefore, only one pair of sheet control plates is projected into the inversion path, and no other, unnecessary control plates are present, so that the chance that a sheet will be hung up on unnecessary sheet control plates is completely eliminated.

According to the fourteenth aspect, a driving force is transmitted to the above rotary shaft from the first roller that rotates in only one direction for feeding in and feeding out a sheet, so that the rotary shaft is rotated in the opposite direction. Thus, a special drive source for controlling the rotary shaft is not required, and the structure can be simplified.

According to the fifteenth aspect of the invention, the side of each sheet control plate that corresponds to the start of the inversion path is extended outward the width of a sheet. Thus, even when the position of a sheet that is fed in is shifted slightly, the sheet can be accepted, so that the chance that a sheet will be jammed in the sheet control plates due to a positioning shift can be completely eliminated.

BRIEF DESCRIPTION OF THE DRAWINGS

In the accompanying drawings:

FIG. 3 is a side view of the sheet inversion device of the invention when a thin sheet is fed in;

FIG. 4 is a side view of the sheet inversion device of the invention when a thick sheet is fed in;

PREFERRED EMBODIMENTS OF THE INVENTION

Figure 1:
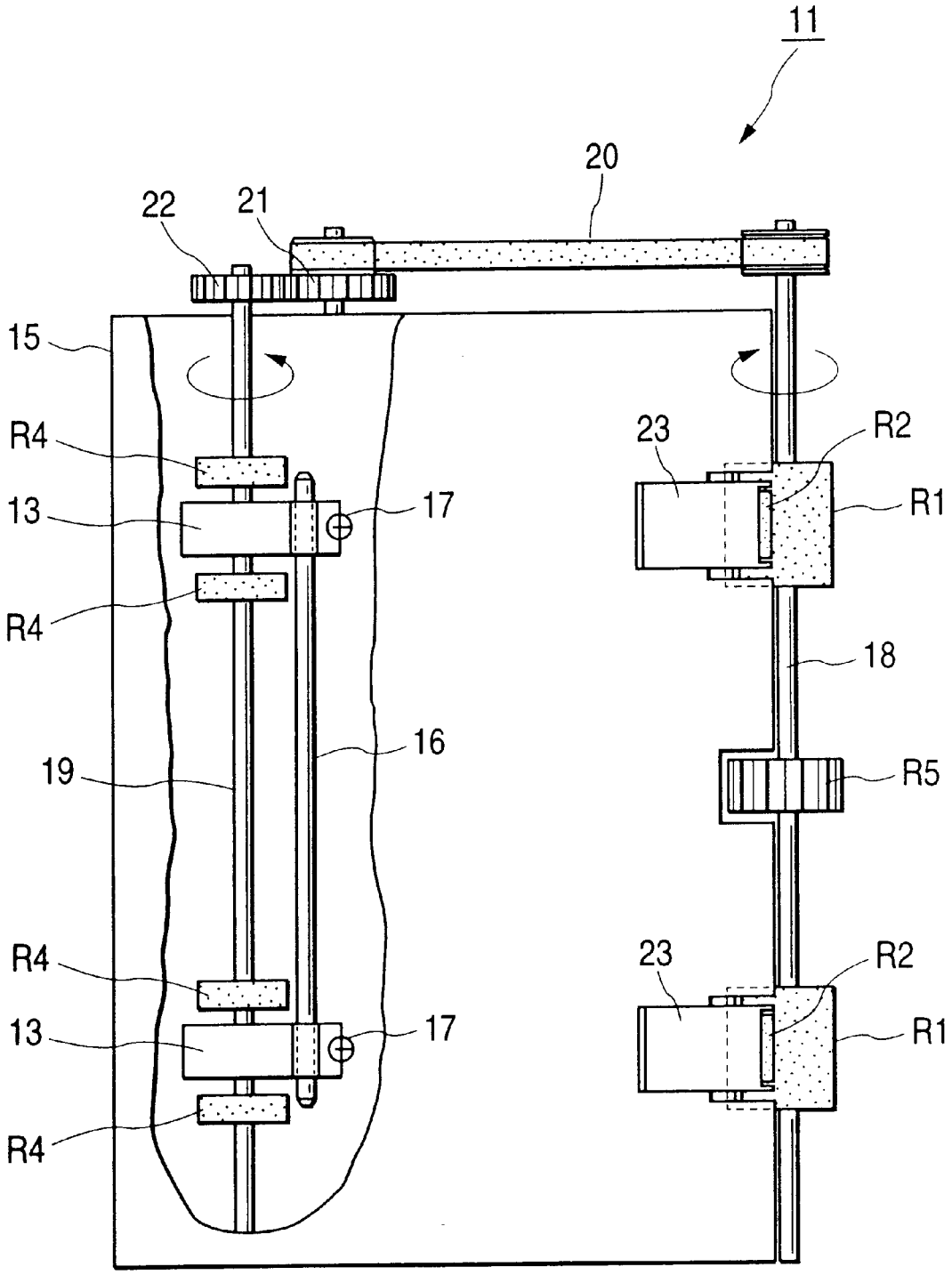
FIG. 1 is a partially exploded, bottom view of a sheet inversion device according to the invention.

Preferred embodiments according to the present invention will be described as follows referring to the accompanying drawings.

One embodiment of this invention will now be described in detail while referring to the drawings.

Figure 2:
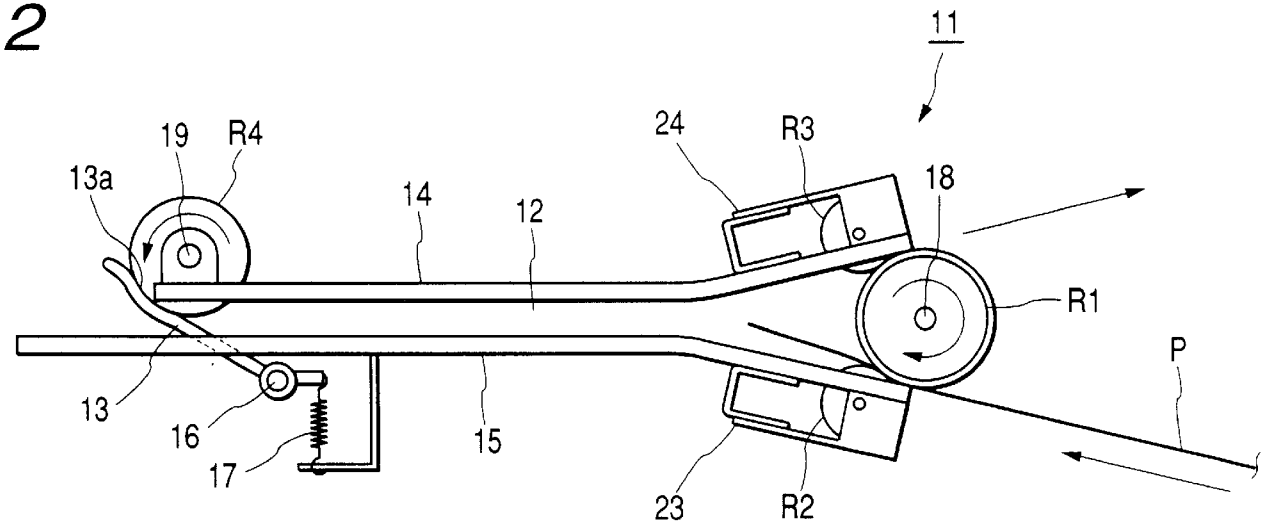
FIG. 2 is a side view of the sheet inversion device of the invention.

As is shown in FIGS. 1 and 2, a sheet inversion device 11 has: a pair of intermediate right and left rollers R1, which are located at the start of an inversion path 12 along which a sheet P is permitted to be input and output and that rotate in one direction; feed-in rollers R2, for sandwiching the sheet with the intermediate rollers R1 and feeding the sheet into the inversion path 12; feed-out rollers R3, which are positioned parallel to the intermediate rollers R1 on the side opposite the feed-in rollers R2 with the intermediate rollers R1 in between, and which are rotated with the intermediate rollers R1 to sandwich and feed the sheet P out of the inversion path 12; inversion rollers R4, which are arranged inside the inversion path 12 and which apply, to the sheet P, a force in the feed-out direction, relative to the sheet feed-in force applied by the rollers R1 and R2, whereby the inversion rollers R4 slip across the sheet P; and pressing guide plates 13, which with the inversion rollers R4 exerts a sheet pressing force that counters the force produced by the advance of the sheet P.

The sheet inversion device 11 can be installed in an arbitrary direction in accordance with the application, and in this embodiment, as is shown in the accompanying drawings, an explanation will be given for a sheet inversion device that is installed on the side. For the inversion path 12, a flat upper plate 14 and a flat lower plate 15 are vertically disposed, describing a gap between them that permits the horizontal input and output of a sheet P. The gap described by the guide plates 14 and 15 is extended outward to form the Y-shaped path 12, at the mouth of which the roller R1 is intermediately positioned. The feed-out roller R3 is supported by the upper guide plate 14 and is arranged above the intermediate roller R1, while the carry-on roller R2 is supported by the lower guide plate 15 and is arranged under the intermediate roller R1.

Further, at an inward location along the inversion path 12, the inversion roller R4, which rotates in the feed-out, direction is secured to the upper guide plate 14, so that the lower outer circumferential face of the inversion roller R4 is exposed at the top of the inversion path 12.

A pressing guide plate 13, positioned below and opposite the inversion roller R4, pivots at a shaft 16, a rotation fulcrum, that is supported by the lower guide plate 15. The distal end of the pressing guide member 13 is raised upward toward the inversion roller R4 by the force produced by a spring 17, which is connected to the base end of the pressing guide member 13.

A widthwise disposed, horizontally extended rotary shaft 18 rotates clockwise at the start of the inversion path 12. The intermediate rollers R1 are arranged in parallel on either end of the rotary shaft 18, and an incised surface roller R5 is arranged at the center of the shaft 18 to improve the feeding performance. As the rotary shaft 18 is rotated, the intermediate rollers R1 are rotated in unison, and accordingly, the respective lower and upper feed-in rollers R2 and feed-out rollers R3 are rotated in opposite directions.

An inversion roller rotation shaft 19 is extended parallel to the rotary shaft 18 to which it is connected by a transmission belt 20 and transmission gears 21 and 22. Upon the receipt of the driving force from the rotary shaft 18, the inversion roller rotation shaft 19 and the coaxial inversion rollers R4 are rotated counterclockwise.

The inversion rollers R4 are so positioned that the distance between the intermediate rollers R1 is slightly shorter than the length of the sheet P. A total of four inversion rollers R4 are positioned, as pairs, at either end of the inversion roller rotation shaft 19. The pressing guide plates 13 are provided between the inversion rollers R4 of the roller pairs, and overlap but do not contact the inversion rollers R4.

Figure 3:
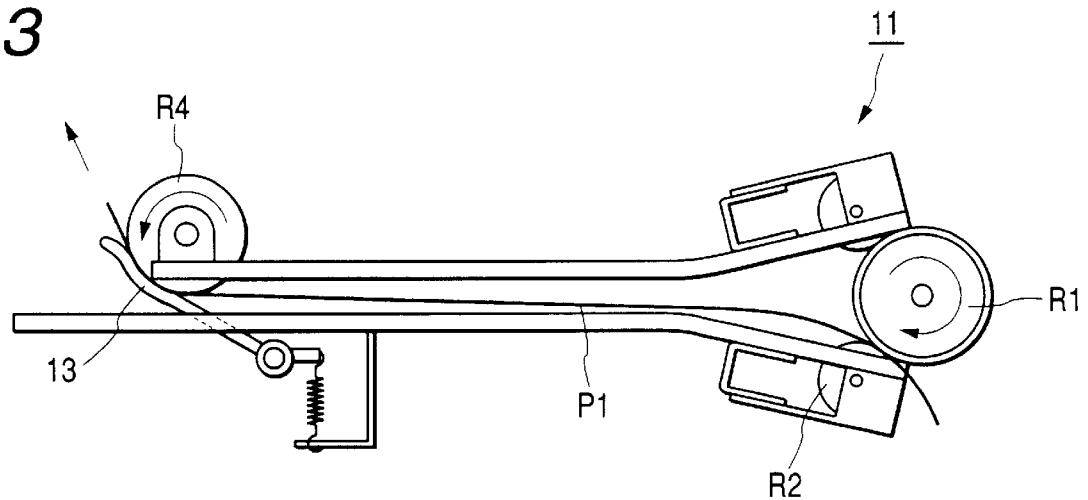

In this case, each of the pressing guide plates 13 is designed so that pressing faces 13*a*, formed at their distal ends, have the same arced shape as have the outer circumferential faces of the inversion rollers R4, so as to prevent an excessive load from being imposed on a thin sheet P and its distal edge from being easily bent. As a result, when a thin sheet P1 is fed in, the displacement of the pressing guide plates 13 is limited, so that the thin sheet P1 is fed in along the outer circumferential faces of the inversion rollers R4 as shown in FIG. 3.

Figure 4:
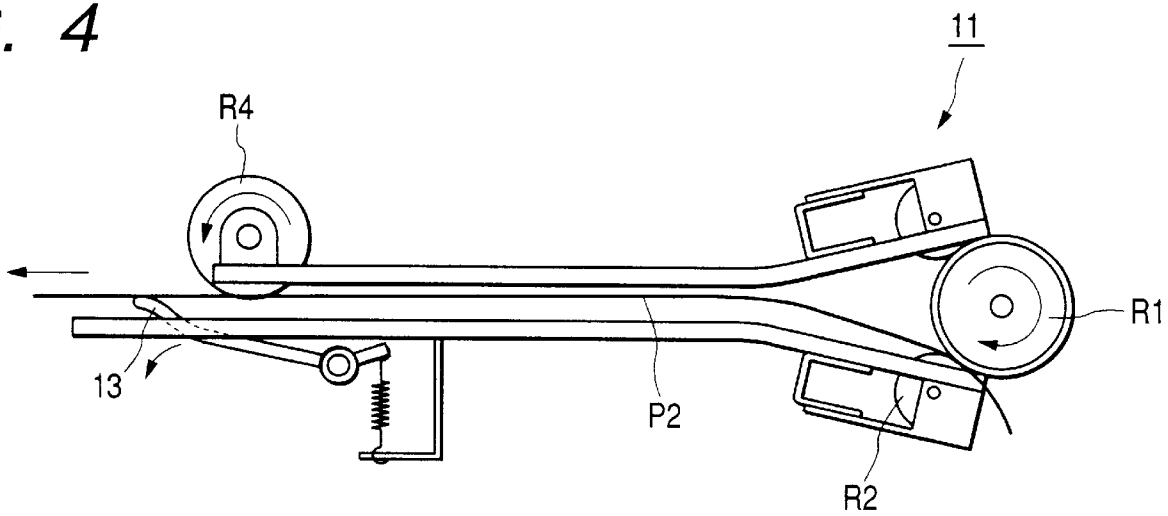

As shown in FIG. 4, when a thick sheet P2 is employed, because of its rigidity, it is linearly introduced into the inversion path 12 and its leading edge pushes down the pressing guide plates 13. Thus, the displacement of the pressing guide plates 13 is pronounced, and a satisfactory pressing force can be obtained. In this manner, consonant with the thickness of a sheet P, a variable pressing force can be produced. In the drawings, feed-in roller holding frames 23 and feed-out holding frames 24 are also provided.

The operation performed by the thus arranged sheet inversion device 11 will now be explained.

As is shown in FIG. 2, one sheet P is introduced at the start of the inversion path 12, and is fed in while sandwiched between the intermediate rollers R1 and the feed-in rollers R2. The sheet P advances linearly along the inversion path 12 and its leading edge is inserted between the inversion rollers R4 and the pressing guide plates 13.

When the sheet P is fed in along the inversion path 12, a pressing force is applied by the pressing guide plates 13 to counter the force driving the sheet P. And when at this time a soft, thin sheet P1 is employed, as is shown in FIG. 3, the thin sheet P1 is inserted between the outer circumferential faces of the inversion rollers R4 and the pressing faces 13*a* of the pressing guide plates 13. Therefore, the thin sheet P1 can be fed in smoothly, without being bent or compressed lengthwise.

Then, when a firm, thick sheet P2 is employed, as is shown in FIG. 4 the thick sheet P2 pushes down the pressing guide plates 13, which apply to the thick sheet P2 a reactive pressing force that is consonant with the thickness of the sheet. Therefore, a comparatively high pressing force can be applied to the thick sheet P2, while it is stably and securely held and fed in.

When the trailing edge of the sheet P is freed from the grasp of the intermediate rollers R1 and the feed-in rollers R2, and the entire sheet P is inside the inversion path 12, the inversion rollers R4, which rotate in the feed-out direction, apply a feeding force to the sheet P. Then, the sheet P is passed between the intermediate rollers R1 and the feed-out rollers R3, and is fed out of the inversion path 12, its surfaces inverted. This inversion process is repeated to individually feed and invert sheets P.

Figure 5:
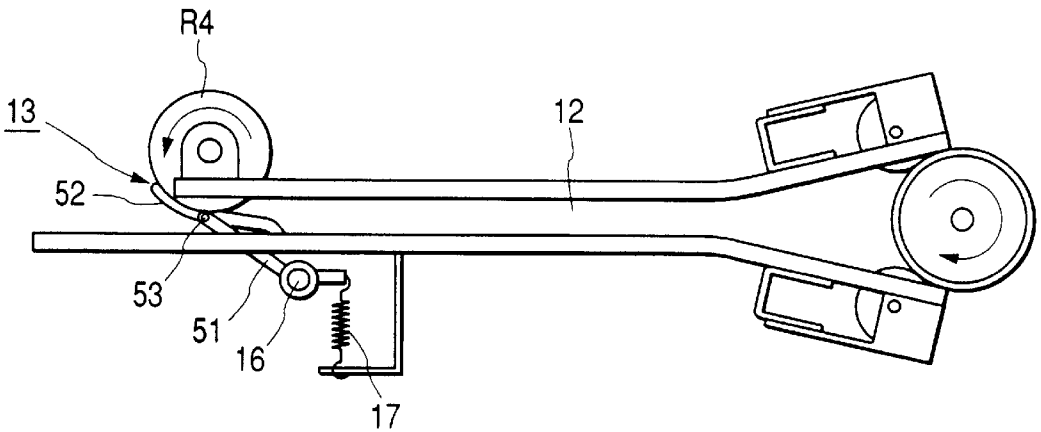
FIG. 5 is a side view of another example of a pressing guide plate according to the invention.

FIG. 5 is a diagram showing another structure example for the pressing guide plate 13. For this structure, as constituents, a pressing arm 51 and a pressing guide piece 52 are employed to form the pressing guide plate 13.

The pressing arm 51 can be pivoted at the support shaft 16 as a fulcrum. And upon the receipt of the urging force produced by the spring 17, which is connected to the base end of the arm 51, the distal end of the arm 51 is urged upward against the inversion roller R4, and supports the pressing guide piece 52 at its center.

The pressing arm 52 has in the same arced shape as has the lower, outer circumferential face of the inversion roller R4. The pressing arm 52 pivots like a teeter-totter at a pivoting fulcrum 53 at its center, so that the face of the pressing arm 52 is disposed along the outer circumferential surface of the inversion roller R4.

Figure 6:
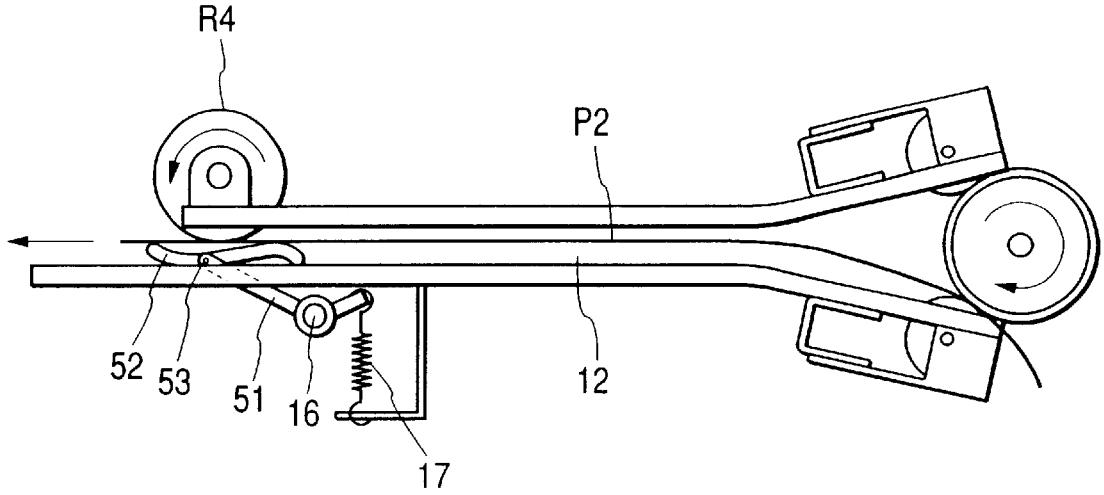
FIG. 6 is a side view of an additional example of a pressing guide according to the invention.

With this arrangement, since the pressing guide piece 52 is pivoted upon the application a driving force transmitted by a thin sheet, a thin sheet can be smoothly fed in. Further, as is shown in FIG. 6, when a thick sheet P2 is fed in, the distal end of the pressing guide piece 52 is pushed down by the leading edge of the thick sheet P2, and is retracted and separated from the opposite inversion roller R4, while the rear end pivots upward at the fulcrum 53 and drives the sheet P2 toward the inversion roller R4.

Therefore, during the process performed to transport the thick sheet P2 to the inversion roller R4, which is supposed to apply the greatest load to the sheet, when the leading edge of the thick sheet P2 passes the inversion roller R4, the thick sheet P2 is forced upward by the rear of the pressing piece guide 52. Therefore, the sheet P2 is not bent and a stable feeding operation is possible. The remainder of the structure is the same as in FIG. 2.

Figure 7:
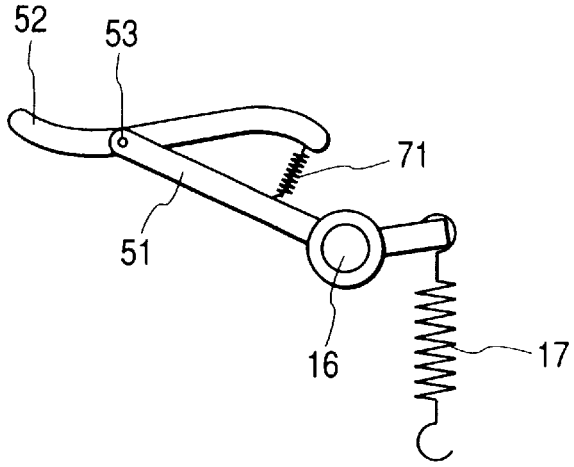
FIG. 7 is an enlarged, side view of the essential portion of an additional example of a pressing guide plate according to the invention.

FIG. 7 is a diagram showing an additional example structure for the pressing guide plate 13. In this example, a spring 71 for adjusting the pivoting distance, is employed to couple with a pressing arm 51, which applies a pressing force, a pressing guide piece 52, which has an arced shape corresponding to the shape of the outer circumferential face of the inversion roller R4.

In this case, when a thin sheet is employed, the spring 71, which adjusts the pivoting distance, elastically supports and pivots the pressing guide piece 52 and transmits a comparatively weak force, so that the thin sheet is appropriately pressed and guided.

And when a thick sheet is employed, the thick sheet is forced upward by the original pressing force applied by the pressing arm 51. Thus, the sheet transporting processing range can be expanded to cover both thin sheets thick sheets.

Figure 8:
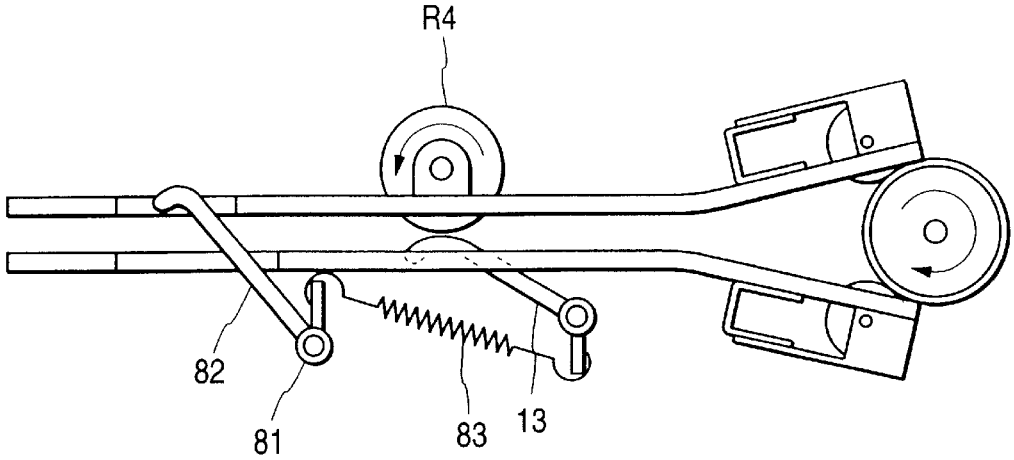
FIG. 8 is a side view of a further example of a pressing guide plate according to the invention.

FIG. 8 is a diagram showing another example structure for the pressing guide plate 13. In this example, a pivoting lever 82 is located forward, separated from the positions of the inversion roller R4 and the pressing guide plate 13 that are exposed through the upper and lower sides of the inversion path 12. The pivoting lever 82 pivots at a fulcrum shaft 81 in the same direction as the pressing guide plate 13, while its distal end faces the inversion path 12. A tension spring 83 is used to connect the pressing guide plate 13 and the pivoting lever 82, and normally, the distal end of the pivoting lever 82 is held facing inside the inversion path 12 by the tension force imposed by the tension spring 83.

Figure 9:
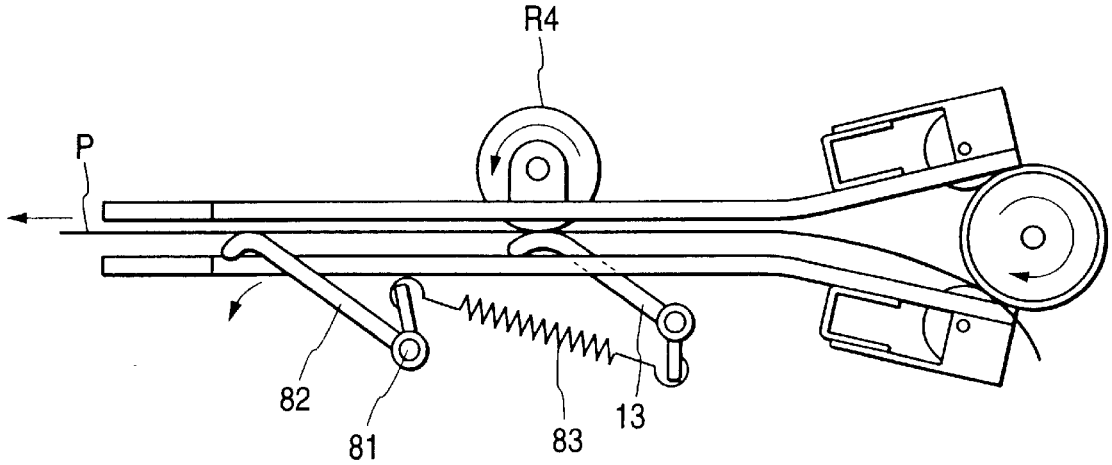
FIG. 9 is a side view of the operating state of the pressing guide plate of the invention in FIG. 8.

When a thick sheet P2 is fed into the inversion path 12, as is shown in FIG. 9, the distal end of the thick sheet P pushes down the pivoting lever 82, and in accordance with this movement, a strong pulling force is applied to the pressing guide plate 13 by the tension spring 83, so that the pressing force between the inversion roller R4 and the pressing guide plate 13 is increased. As a result, when no feeding force is applied to the trailing edge of the thick sheet P2, it can be discharged in the feed-out direction by the force applied by the inversion roller R4.

Figure 10:
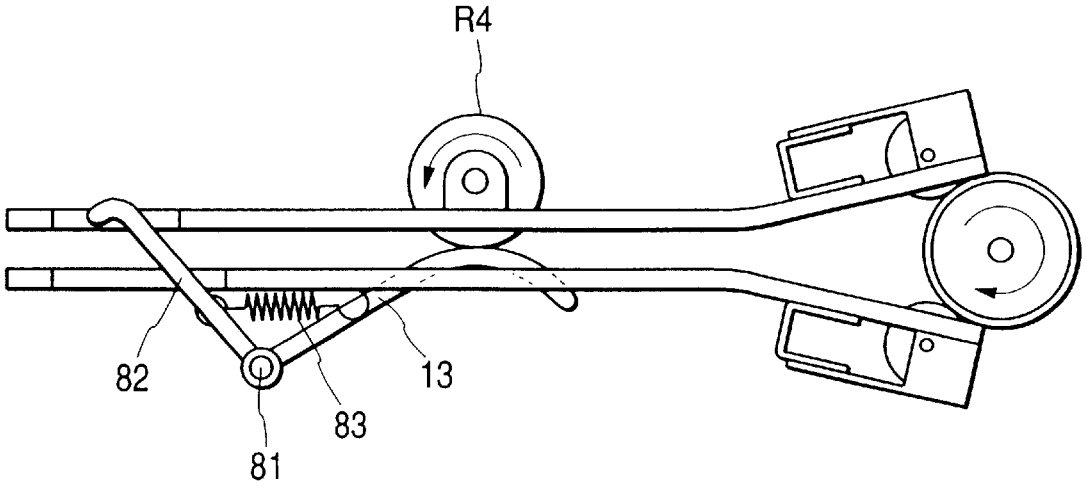
FIG. 10 is a side view of a still further example of a pressing guide plate according to the invention.

FIG. 10 is a further example structure of the pressing guide plate 13. In this example, the base ends of the pivoting lever 82 and the pressing guide plate 13 are fitted over the same fulcrum shaft 81, and are coupled together by the tension spring 83. In this case, the same effects are obtain as in FIG. 8.

Figure 11:
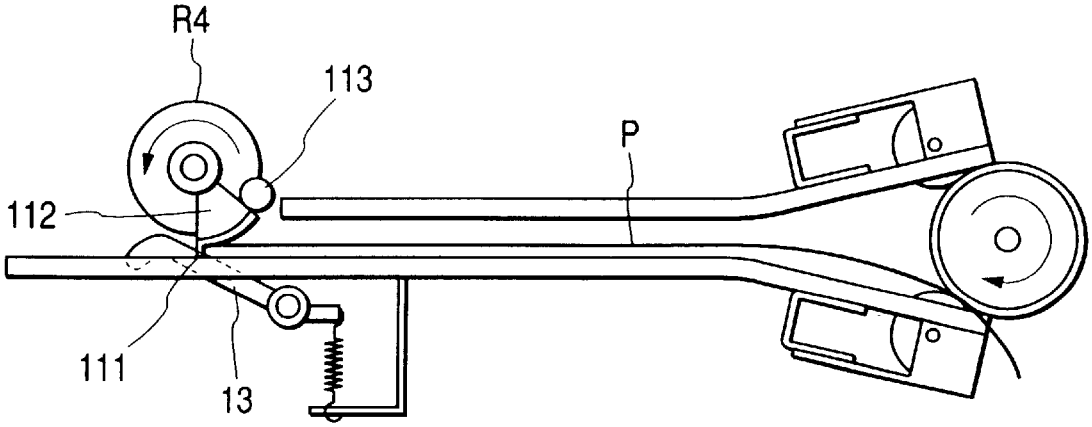
FIG. 11 is a side view of another example of a pressing structure according to the invention.
Figure 12:
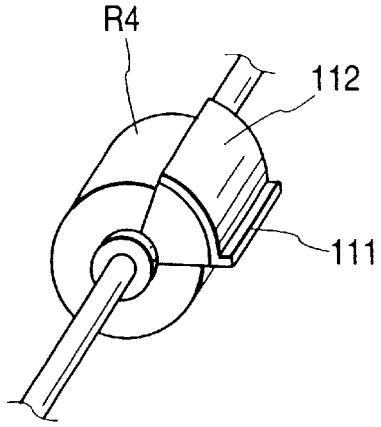
FIG. 12 is a perspective view of the essential portion of a fan-shaped rotary member according to the invention.

FIGS. 11 and 12 are diagrams showing another example of the inversion roller R4. In this example, a fan-shaped rotary member 112 is provided that is rotated or retracted upon the application of a driving force transmitted by the leading edge of a sheet P. The fan-shaped rotary member 112, which covers part of the inversion roller R4, has a projection 111 that is coaxially arranged with the rotary shaft 19 of the inversion roller R4, and that is contacted by the leading edge of the sheet P that is being fed. When the upward pressing force exerted by the pressing guide plate 13, which, in the feed-out direction, is pressed down, is applied to the fan-shaped rotary member 112, the fan-shaped rotary member 112 engages a positioning stopper piece 113 and is held in its initial position. In the standby state, while the fan-shaped rotary member 112 is held in its initial position, the positioning of the pressing guide plate 13 is controlled by the fan-shaped rotary member 112, and the pressing force exerted toward the inversion roller R4 is suppressed.

Under this condition, when a sheet P is fed in, as is shown in FIG. 11, the leading edge of the sheet P abuts upon the projection 111 of the fan-shaped rotary member 112, and does not contact the inversion roller R4. Therefore, no load is applied to the sheet P by the inversion roller R4, which is rotated in the feed-out direction, and the sheet P can be fed in smoothly.

Figure 13:
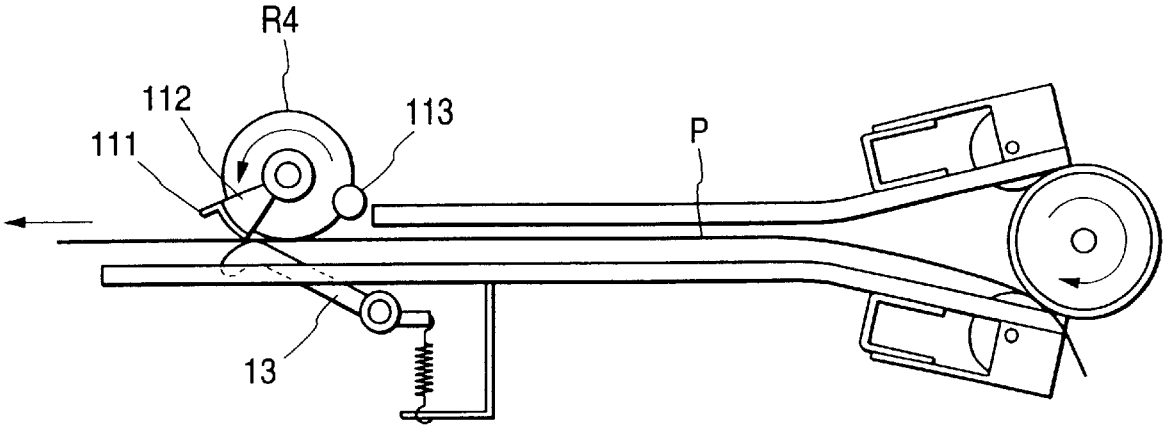
FIG. 13 is a side view of the operating state of a fan-shaped rotary member according to the invention.

Thereafter, as is shown in FIG. 13, when the sheet P passes the inversion roller R4 while the rotating fan-shaped rotary member 112 is pushed and the pressing guide plate is retracted by the leading edge of the sheet P, the outer face of the inversion roller R4 is exposed. Then, inversion roller R4 contacts the sheet P, which is forced upward by the pressing guide plate 13, an applies a feed-out force to it. Thus, when the trailing edge of the sheet P has passed through and been freed from the grasp of the intermediate rollers R1 and the feed-in rollers R2, and the feed-in force is no longer applied to the sheet P, the sheet P is fed in the feed-out direction.

Figure 14:
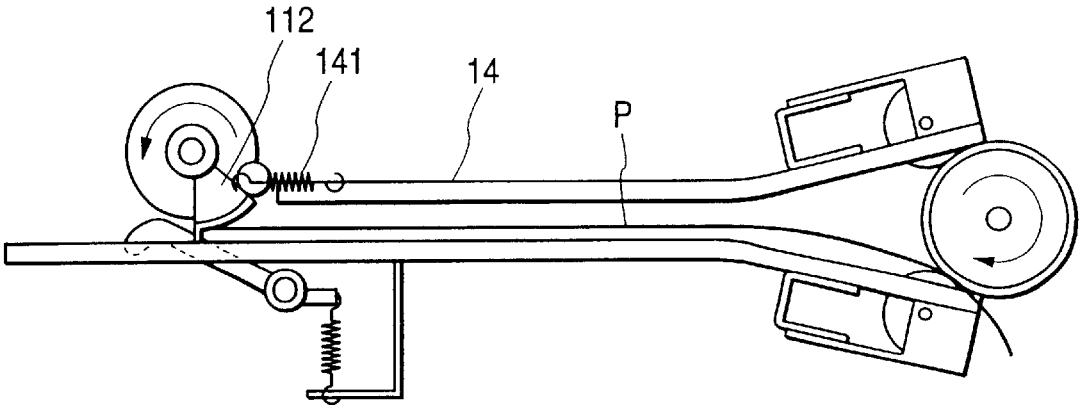
FIG. 14 is a side view of an additional example of a pressing structure according to the invention.

FIG. 14 is a diagram showing an example wherein the fan-shaped rotary member 112 is coupled with the upper guide plate 14 by a spring 141 to position the fan-shaped rotary member 112 in its initial position. In this case, the sheet P is fed in against the urging force exerted by the spring 141, and when the sheet P is fed out, the fan-shaped rotary member 112 is returned to its initial position by the recovery force exerted by the sprint 141.

Figure 15:
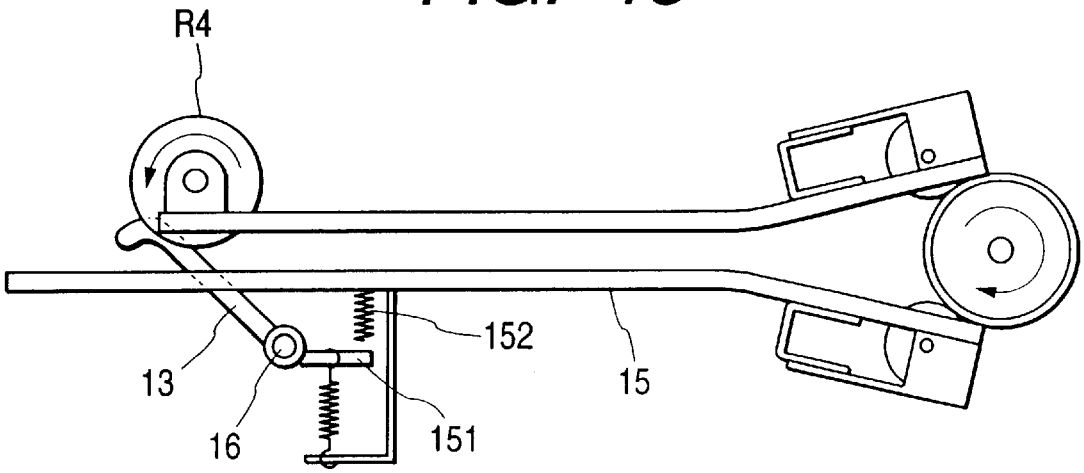
FIG. 15 is a side view of one more example of a pressing guide plate according to the invention.

FIG. 15 is a diagram showing one more example pressing guide plate 13. In this example, a retraction control spring 152 is provided on the lower face of the lower guide plate 15, which faces a base piece 151 extending from a support portion to the base end of the pressing guide plate 13 that is fitted over the shaft 16. The retraction spring 152 controls the distance the pressing guide plate 13 is retracted when it is pivoted in the retraction direction.

Figure 16:
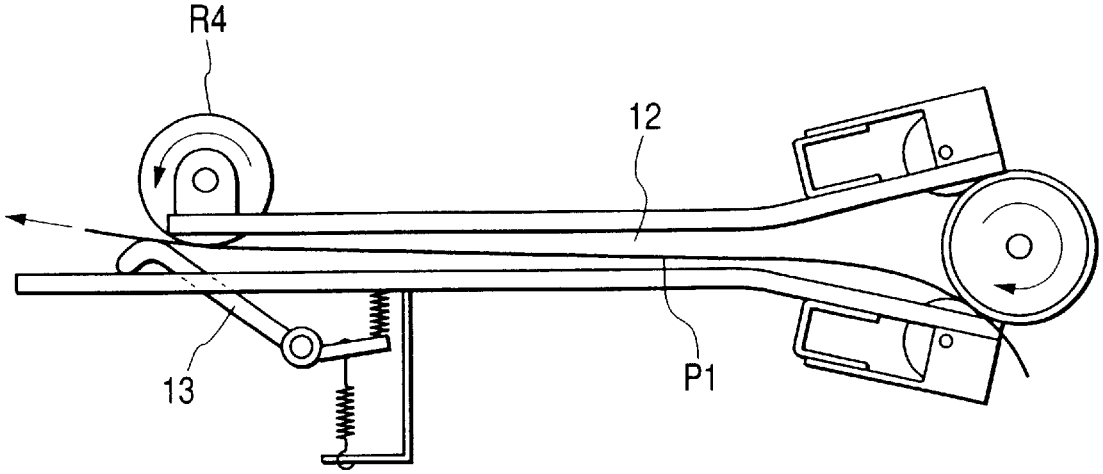
FIG. 16 is a side view of the pressing guide plate of the invention in FIG. 15 when a thin sheet is employed.

Therefore, as is shown in FIG. 16, when a thin sheet P1 enters the inversion path 12, the pressing guide plate 13 is retracted by the driving force transmitted by the thin sheet P1, and the thin sheet P1 is pressed upward and guided by the original pressing action of the pressing guide plate 13. Thus, the thin sheet P1 can be fed in smoothly.

Figure 17:
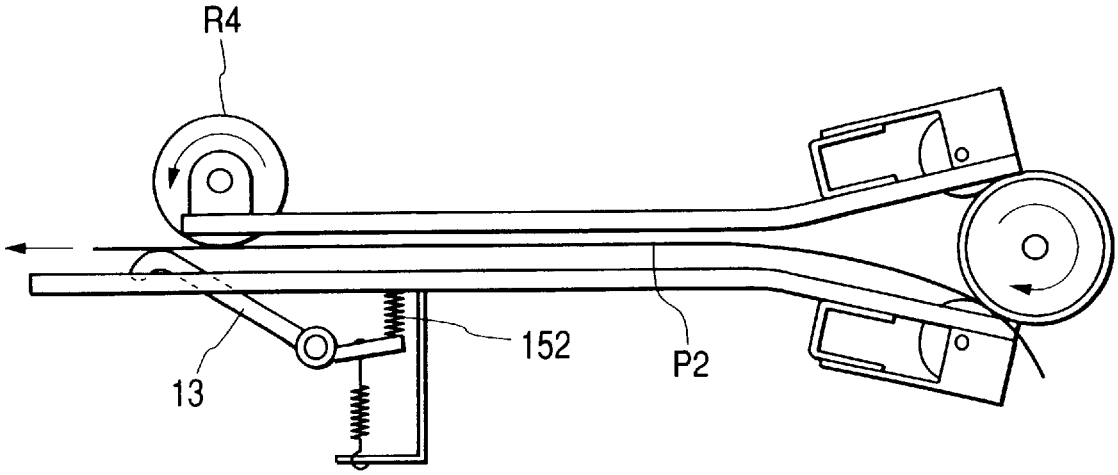
FIG. 17 is a side view of the pressing guide plate of the invention in FIG. 15 when a thick sheet is employed.

When, as is shown in FIG. 17, a thick sheet P2 enters the inversion path 12, the pressing guiding plate 13 is pushed down and retracted by the driving force transmitted by the sheet P2, and the elastic support force exerted by the retraction control spring 15 is increased in consonance with the thickness of the sheet P2. As a result, an elastic support action consonant with weight of the thick sheet P2 can be obtained.

Figure 18:
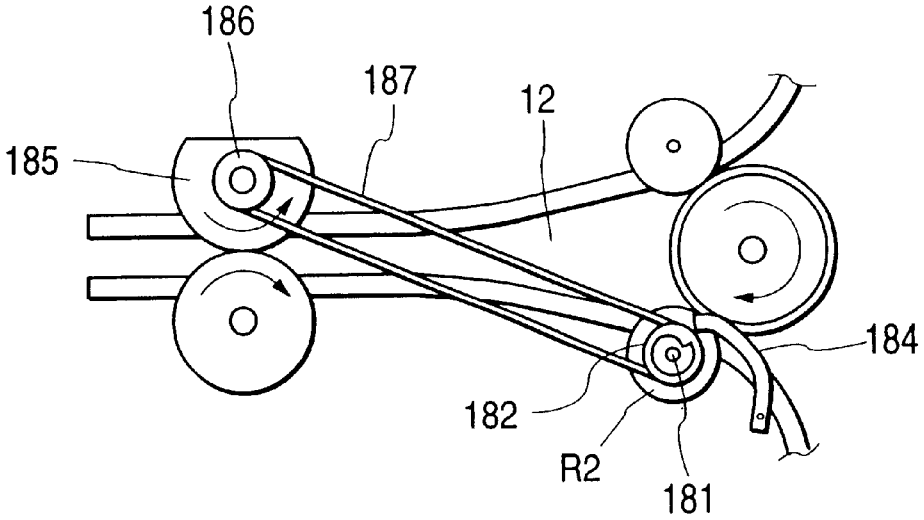
FIG. 18 is a side view of another example structure of an inversion path according to the invention.
Figure 19:
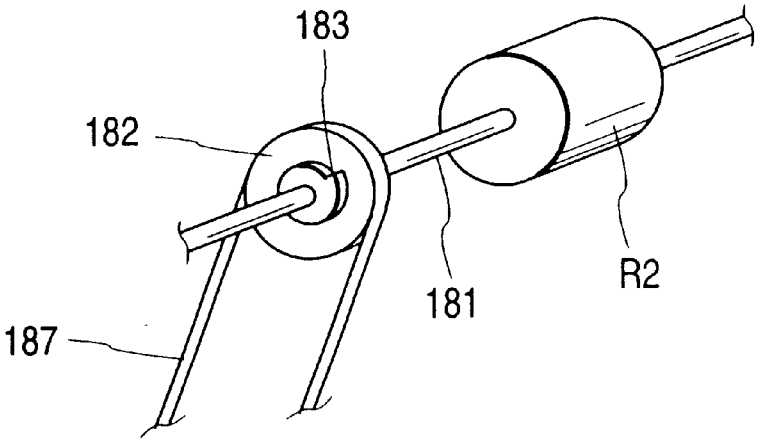
FIG. 19 is a perspective view of the essential portion of an engagement step in this example structure for the inversion path of the invention.

FIG. 18 is a diagram showing another example inversion path 12. In this example, a first pulley 182 is fitted around a rotary shaft 181 of the feed-in roller R2, and as is shown in FIG. 19, an engagement step 183, for restricting rotation, is formed on the end face of the first pulley 182. Then, when the distal end of a feed-in lever 184 engages the engagement step 183, the feed-in lever 184 is brought in contact with the outer circumferential face of the intermediate roller R1.

In this case, a torque limiter is provided for the first pulley 182, and when a sheet is not being fed, the engagement step 183 of the first pulley 182 is rotated counterclockwise.

Then, when a sheet P is inserted between the intermediate roller R1 and the feed-in roller R2, the feed-in lever 184 is pushed down. And at this time, the distal end of the feed-in lever 184 engages the engagement step 183 and halts the rotation of the first pulley 182, and slipping occurs due to the action of the torque limiter.

Figure 20:
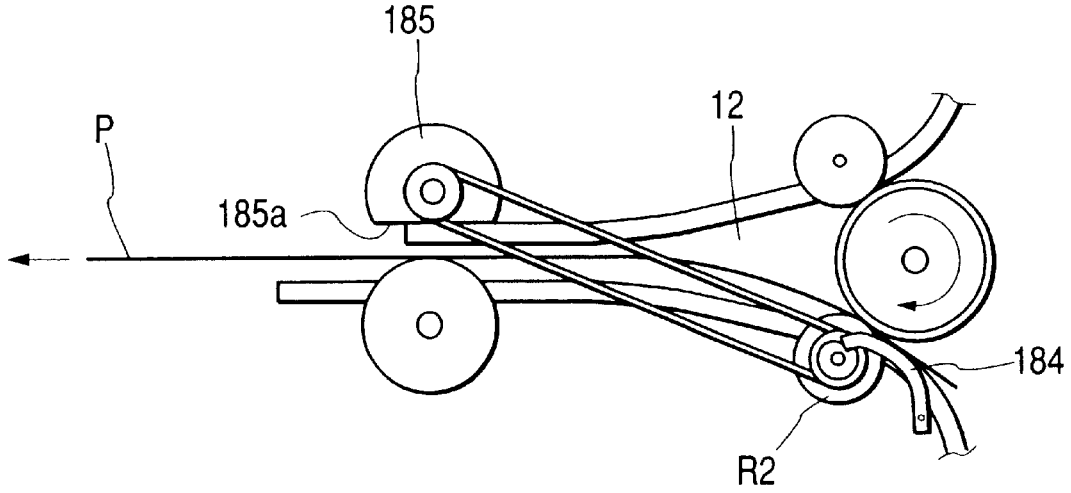
FIG. 20 is a side view of the state where a sheet is fed into this example structure of the inversion path of the invention.

A transmission belt 187, for feeding in the sheet P, is employed to connect the first pulley 182 and a second pulley 186, which is fitted around the same rotary shaft 185 as an inversion roller 185 having a semicircular shape. And when, as the sheet P is being fed in, the feed-in lever 184 engages the engagement step 183 and halts the rotations of the first and the second pulleys 182 and 186, as is shown in FIG. 20, the semicircular inversion roller 185 is positioned so that a notched face 185a is parallel to the inversion path 12, and the state wherein no pressing force is applied is maintained.

Figure 21:
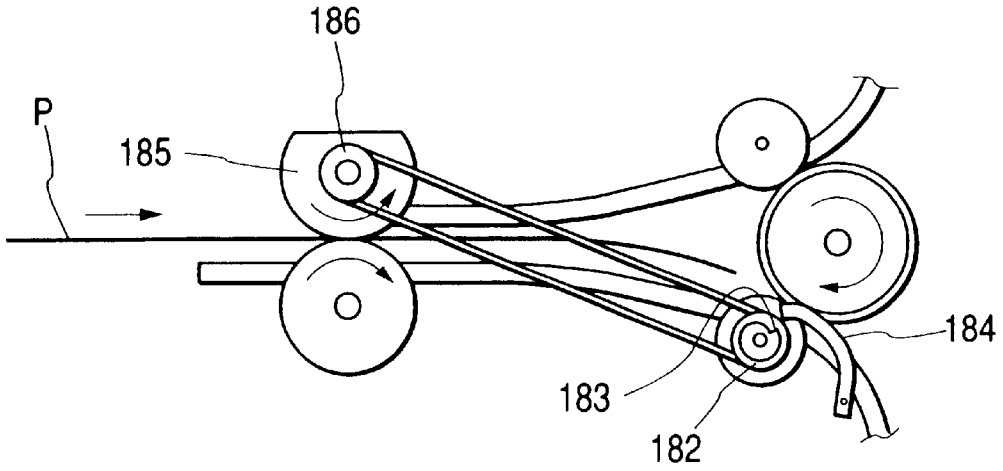
FIG. 21 is a side view of the state where the sheet has been fed into this example structure of the inversion path of the invention.

Thereafter, as is shown in FIG. 21, when the trailing edge of the sheet P passes the position of the carry-lever 184, the first and the second pulleys 182 and 186 are synchronously rotated by disengaging the engagement step 183 from the feed-in lever 184, and accordingly, the inversion roller 185 begins to rotate. Thus, the force exerted in the feed-out direction is applied.

As is described above, the pressing guide plate 13 can be replaced by the semicircle inversion roller 185.

Figure 22:
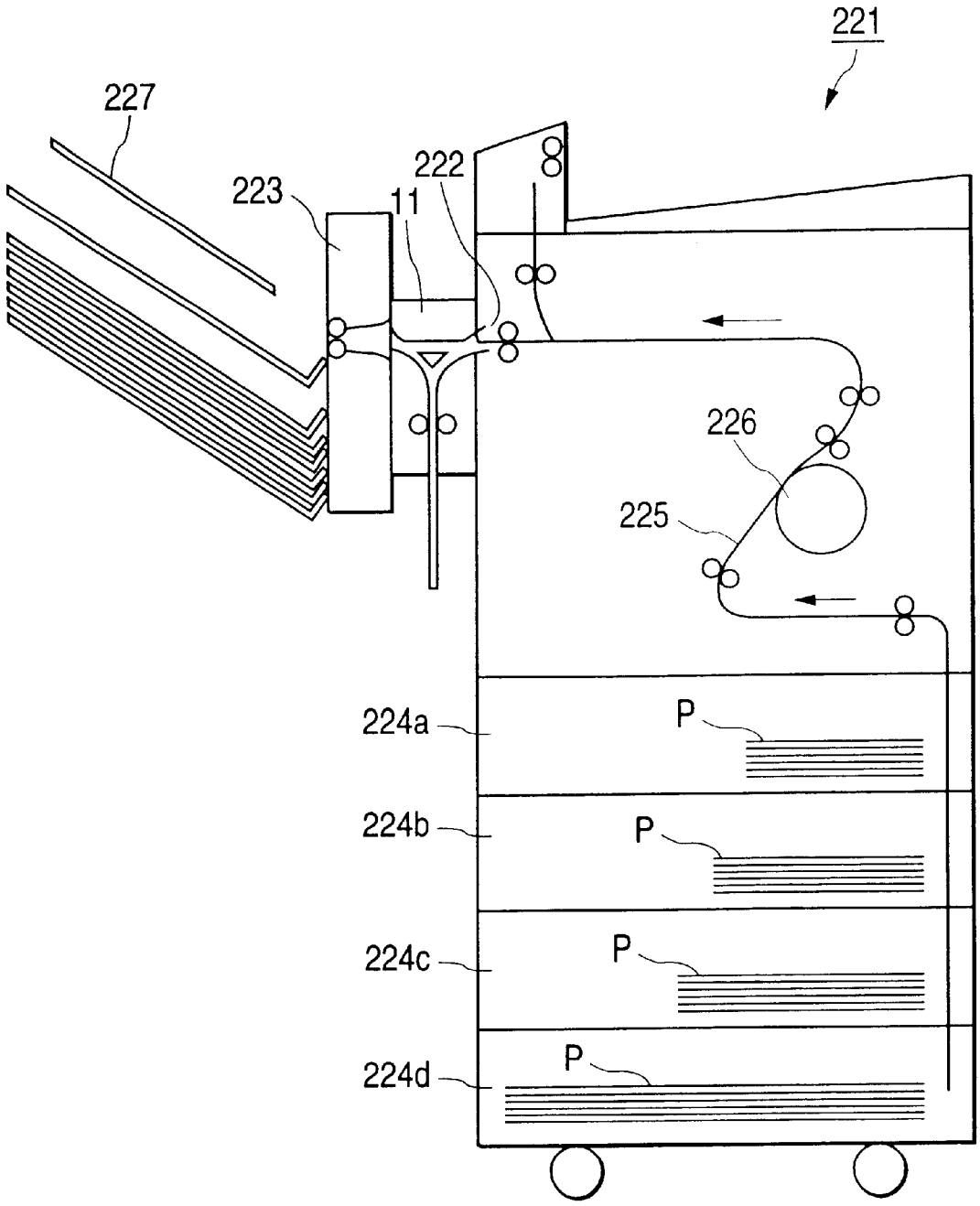
FIG. 22 is a schematic side view of an example where the sheet inversion device of this invention is incorporated in a copier.

FIG. 22 is a diagram showing a copier 221 that employs the sheet inversion device 11 of the invention. The sheet inversion device 11 is arranged upright between a sheet discharge port 222 and a sorter 223 of the copier 221. Each sheet P is supplied from one of sheet cassettes 224*a* to 224*d* inside the copier 221, and an image is transferred to the sheet P at a transfer drum 226 positioned along a sheet feeding path 225. The image bearing sheet P is introduced into and inverted by the sheet inversion device 11. Thereafter, at the succeeding stage, the sheet P is discharged, via the sorter 223, to a discharge tray 227.

As a result, when multiple copies are completed and all the print sheets are stacked on the discharge tray 227, the printed sheets in order, in accordance with the page numbers.

Figure 23:
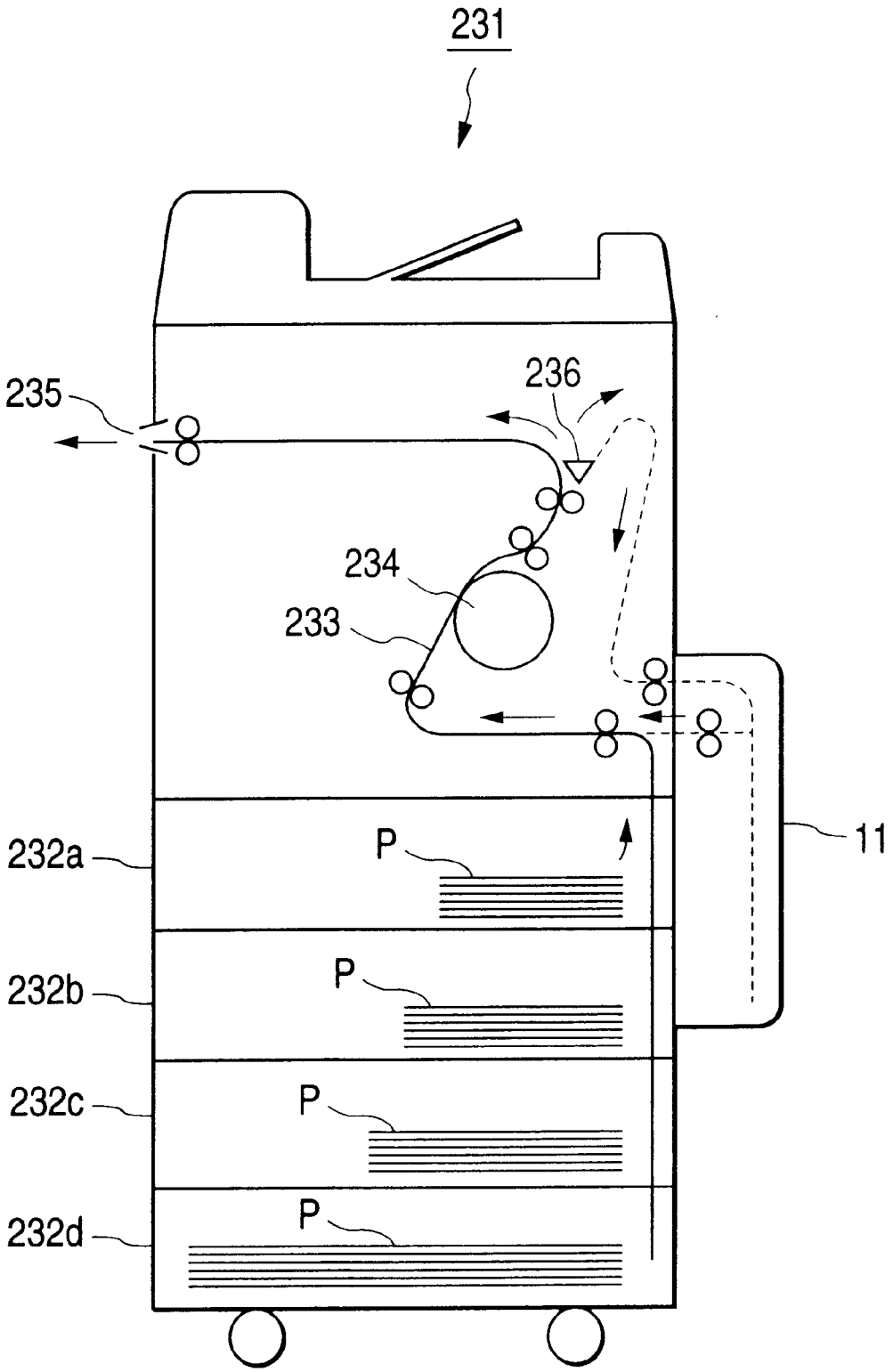
FIG. 23 is a schematic side view of an example where the sheet inversion device of this invention is incorporated in a double-side copier.
Figure 24:
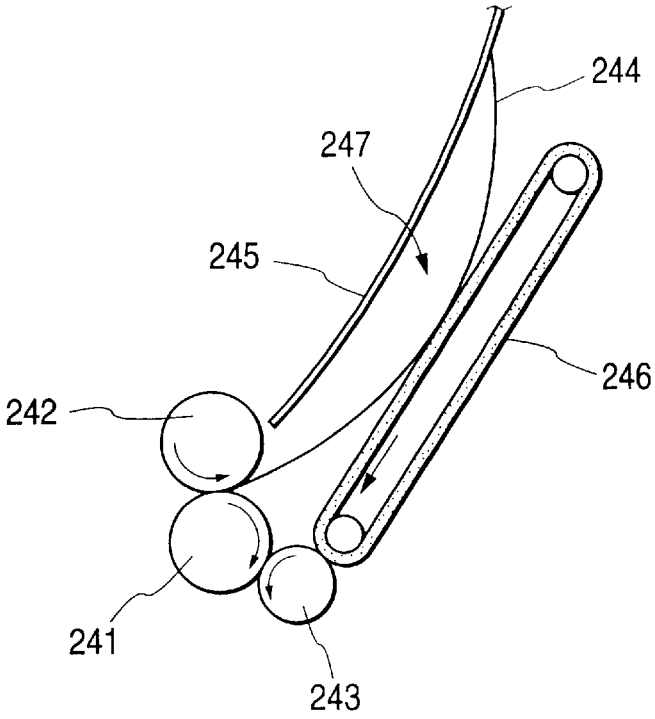
FIG. 24 is a schematic view of a conventional sheet inversion device.

FIG. 23 is a diagram showing a double-side copier 231 that employs the sheet inversion device 11 of this invention.

In this case, the sheet inversion device 11 is attached upright on one side of the double-side copier 231. A sheet P is supplied from one of sheet cassettes 232*a* to 232*d* inside the copier 231, and an image is transferred to the sheet P at a transfer drum 234 positioned along a sheet feeding path 233. When double-side printing is required, the sheet P is sorted by an inversion flapper 236 and is introduced to the sheet inversion device 11. After the sheet P has been inverted, it is again fed to the starting end of the sheet feeding path 233, and an image is transferred to the other face of the sheet P at the transfer drum 234. In this manner, the double-side printing process is completed, and the sheet P is thereafter discharged from a sheet discharge port 235. When the sheet inversion device 11 is employed for such a double-side copier, the inversion operation can be stably performed for various types of sheets having a variety of thicknesses.

As is described above, when a sheet, sandwiched between rollers, is fed from the starting end of an inversion path, and the leading edge of the sheet reaches and is inserted between the inversion rollers and the pressing guide plates positioned along the inversion path, at this time the sheet is fed in, while the pressing guide plates apply to the sheet a sheet pressing force to counter the force produced by the advance of the sheet. Further, since the pressing faces of the pressing guide plates have the same arced shape as has the outer circumferential face of the inversion rollers, when a thin, comparatively weak sheet is introduced into the inversion path, it is fed in while the leading edge of the thin sheet slides along the arc shaped faces of the guide plates and the outer circumferential face of the inversion roller. Thus, the displacement of the pressing guide members is limited and an appropriate pressing force is stably applied to the thin sheet. On the other hand, since a strong linear force is projected by a thick, strong sheet as it is fed in the feed-in direction, as the thick sheet enters its leading edge pushes down the forward pressing guide member. Thus, the displacement of the pressing guide member is pronounced and the reactive pressing force is proportionally increased, so that a satisfactory strong large force can be obtained for the thick sheet. As a result, a variable pressing force is obtained and applied in accordance with the thickness of a sheet. Therefore, a thin, soft sheet can be smoothly fed in, and a thick sheet can be securely held and smoothly inverted.

Further, when the pressing guide plate is divided into the pressing arm and the pressing guide piece and when the pressing portion has a pivoting function like a teeter-totter, which pivots forward and backward, the pressing guide plate is automatically moved in consonance with the feeding of the sheet. Further, since the pressing guide piece is pivoted forward or backward in the feeding direction and the distal end or the rear end is pressed against the sheet, during the sheet feed-in process in which the greatest load is applied to the sheet, the pressing guide plate is pivoted and retracted to reduce the load received by the leading edge of the sheet. Therefore, the bending or the wrinkling of the sheet can be prevented and a stable feeding operation can be performed.

Furthermore, when the pivoting adjustment spring is employed to couple the pressing guide piece with the pressing arm, and the displacement of the guide piece is limited or pronounced, depending on whether the sheet is thin or thick, a pressing force is applied to the sheet in consonance with its thickness. Therefore, for the sheet transporting process a wide range of thin and thick sheets can be covered.

When the tension spring is employed to couple the pressing guide plate with the pivoting lever that is pivoted and retracted upon the application of the force produced by the advance of the sheet, the pressing guide plate can interlock with the movement of the pivoting lever and press against the sheet. At this time, the pivoting distance of the pressing guide plate differs in accordance with the thickness of the sheet, and in consonance with the pivoting distance, an appropriate pressing force can be automatically obtained.

In addition, if, while the structure of the pressing guide plate is unchanged, the structure of the inversion roller is changed by employing the fan-shaped rotary member, the smooth inversion function can also be obtained by using the force produced by the advance of a sheet.

Moreover, the pressing guide plate can include not only a spring that acts in common for a thin sheet and a thick sheet, but also a retraction control spring that is specifically intended for use with a thick sheet. Then, when a thick sheet is fed in, the retractive control spring increases the elastic support force in accordance with the thickness of the sheet so that the thick sheet is elastically supported. As a result, a appropriate pressing force can be obtained for both a thin sheet and a thick sheet.

According to the correlation of the invention with the structure of the embodiment described above, the first roller of the invention corresponds to the intermediate roller R1 in the embodiment: Similarly,

- the second roller corresponds to the feed-in roller R2;
- the third roller corresponds to the feed-out roller R3;
- the fourth roller corresponds to the inversion roller R4 or the semicircular inversion roller 185;
- the pressing guide member corresponds to the pressing guide plate 13;
- the first member corresponds to the pressing arm 51;
- the second member corresponds to the pressing guide piece 52;
- the elastic member for adjusting the pivoting distance corresponds to the spring 71;
- the urging means corresponds to the tension spring 83;
- the contact face corresponds to the projection piece 111;
- the rotary member corresponds to the fan-shaped rotary member 112; and
- the elastic retraction control member corresponds to the retraction control spring 152.

However, this invention can be variously applied based on the technical ideas represented by the claims, and is not limited to the above described embodiment.

Preferred embodiments of the sheet conversion device will now be further described referring to the accompanying drawings.

Figure 25:
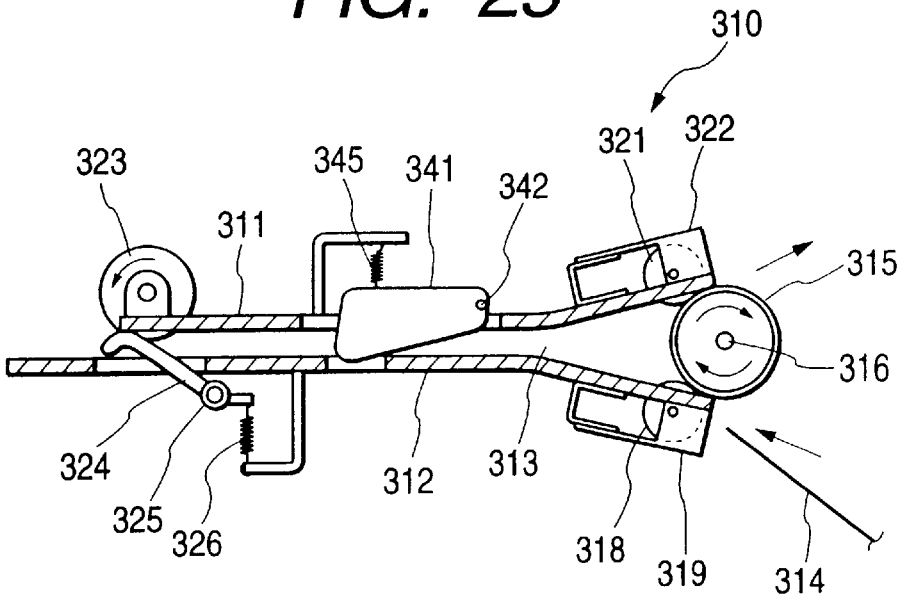
FIG. 25 is a cross-sectional side view of a sheet inversion device according to one embodiment.
Figure 26:
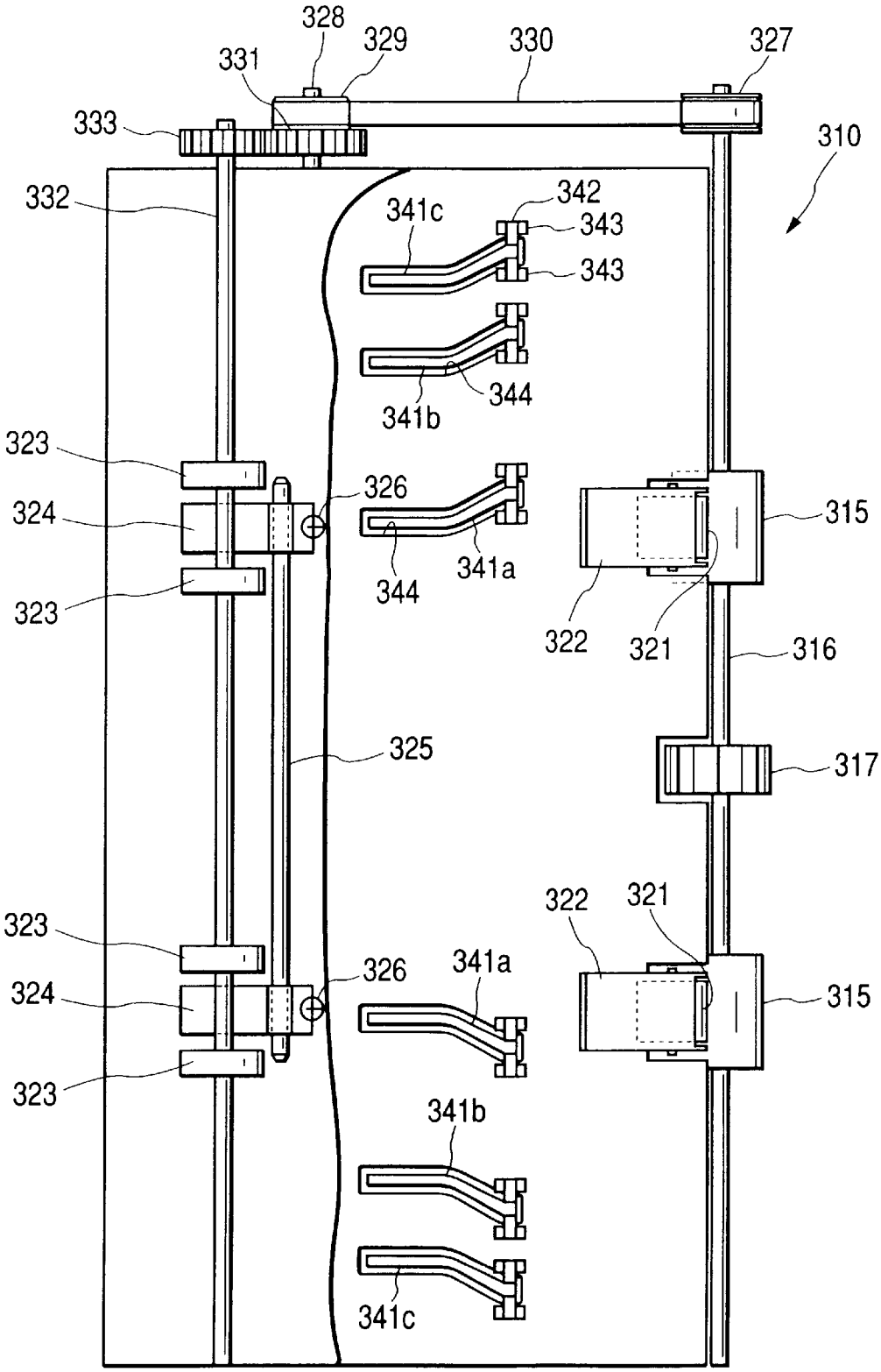
FIG. 26 is a partially cutaway plan view of the sheet inversion device.

FIGS. 25 and 26 are diagrams illustrating a sheet inversion device 310 according to the present embodiment. In the sheet inversion device 310, an inversion path 313 is formed by two facing guide plates 311 and 312, and the portions of the guide plates 311 and 312 that are near the start of the inversion path 313 open outward like a funnel.

First rollers 315 are fitted around a rotary shaft 316 at parallel two locations in the widthwise direction and symmetrically in the center in the direction of the thickness of the start of the inversion path 312. The axes of the rollers 315 face in the direction in which a sheet 314 can be fed in and fed out along the inversion path 313, i.e., in the widthwise direction of the inversion path 313. The rotary shaft 316 is rotated in one direction (clockwise in FIG. 25) only by an appropriate driving source. And a paddle roller 317 is securely mounted at the center of the rotary shaft 316. The paddle roller 317 has an incised surface for applying friction to the sheets 314.

On the side whereat a sheet 314 is fed by the first rollers 315, second rollers 318 are arranged facing the first rollers 315. The second rollers 318 rotate with the first rollers 315 to feed a sheet 314 into the inversion path 313. The second rollers 318 are supported by frames 319, which are secured to the guide plate 312.

On the side whereat a sheet 314 is discharged from the inversion path 313, i.e., the opposite side of the first rollers 315 whereat the second rollers 318 are positioned, third rollers 321 are arranged in parallel facing the first rollers 315. The third rollers 321 rotate with the first rollers 315 to discharge (to feed out) a sheet from the inversion path 313. The third rollers 321 are supported by frames 322, which are fixed to the guide plate 311.

A plurality of fourth rollers 323 are supported on the side near the inversion path 313 and outside the guide plate 311 (upper side in FIG. 35) at a position that a sheet 314 passes. Part of the outer surface of each fourth roller 323 is exposed inside the inversion path 313.

While in each of two pairs the fourth rollers 323 are positioned at a predetermined interval, the two pairs are arranged in the widthwise direction of the inversion path 313 at an interval that corresponds to the minimum width of the sheets 314 that can be handled by these two roller pairs. Between the fourth rollers 323 of each pair, a pressing lever 324 is obliquely projected outward from the opposite guide plate 312, so that its distal end slightly overlaps the outer faces of the fourth rollers 323. The fourth rollers 323 apply a driving force to the sheets 314 in the discharge direction.

The base ends of the pressing levers 324 are fitted over a fulcrum shaft 325 that is supported outside the guide plate 312, and the pressing members 324 are maintained in predetermined positions (positions overlapping the rollers 323) by springs that are connected to the base ends.

When the leading edge of a sheet 314 abuts upon the pressing levers 324, the pressing levers 324 are retracted to permit the leading edge of the sheet 314 to pass the fourth rollers 323. Thereafter, the pressing levers 324 urge the sheet 314 toward the fourth rollers 323, which apply a feeding force in the discharge direction to the sheet 314. The pressing force of each pressing lever 324 (the urging force of a spring 326) is set so that because of the feeding force applied to a sheet 314, the fourth rollers 323 slip across the sheet 314 until the sheet 314 is released from the force exerted in the feeding direction (is free), and the fourth rollers 323 can apply a force in the discharge direction to the sheet 314.

The drive force is transmitted from the rotary shaft 316 of the first rollers 315 to the fourth rollers 323. That is, a belt 330 is placed around a pulley 327 that is fixed to the end of the rotary shaft 316 and a pulley 329 that is fitted around a middle idler shaft 328. Further, a gear 331 is coupled (continuously engaged) with the pulley 329, while a gear 333 is fixed to the end of a shaft 332 on which the fourth rollers 323 are fitted. When the gear 333 engages the gear 331, the drive force for the rotary shaft 316 of the first rollers 315 is be transmitted to the fourth rollers 323.

Sheet control plates 341 are arranged on the guide plate 311 of the inversion path 313 in the middle between the first rollers 315 and the fourth rollers 323. The sheet control plates 341 control the sheets 314 and guide them to predetermined positions in accordance with the widths (e.g., there are three types) that are employed, in order to prevent the sheets 314 from being skewed.

The pairs of sheet control plates 341 are provided on the right and the left sides in consonance with the width of the sheets 314, and the sheet control plate pairs 341*a*, 341*b* and 341*c* are arranged so that the widthwise center line of the inversion path 313 is aligned with the center lines of the sheets 314.

For each sheet control plate 141, a shaft portion 242, the base end of which is fitted into bosses 343 that are formed outside the guide plate 311, is rotatably supported. A notch 344 is formed in the guide plate 311 at a position corresponding to each sheet control plate 341. Each of the sheet control plates 341 is exposed, via the notch 334, to the inversion path 313, so that the free end of the plate 341 is lower than the inversion path 313 and the inner edge is inclined.

The base ends (the start of the inversion path 313) of the sheet control plates 341 are extended outward from the width of a corresponding sheet 314. Further, springs 345, which are connected to the free end sides of the sheet control plates 341 and are located outside the inversion path 313, are employed to maintain the sheet control plates 341 at the position where the sheet 314 is regulated. However, when the sheet 314 larger than the control target is fed, this sheet 314 runs on to the pertinent sheet control plates 341. Therefore, the elastic force of the spring 345 is set to the urging force by which the sheet control plates 341 can be retracted.

The inversion process performed by the thus arranged sheet inversion device 310 will now be described while referring to FIGS. 27A and 27B. The rotary shaft 316 for the first rollers 315 is rotated by an appropriate drive source (motor) in one direction (clockwise) indicated by an arrow in FIG. 25. Upon receipt of the drive force from the rotary shaft 316, the support shaft 332 of the fourth rollers 323 are rotated in the direction (counterclockwise) indicated by an arrow in FIG. 25, and exerts the force to the sheet 314 in the sheet discharge direction.

Figure 27A:
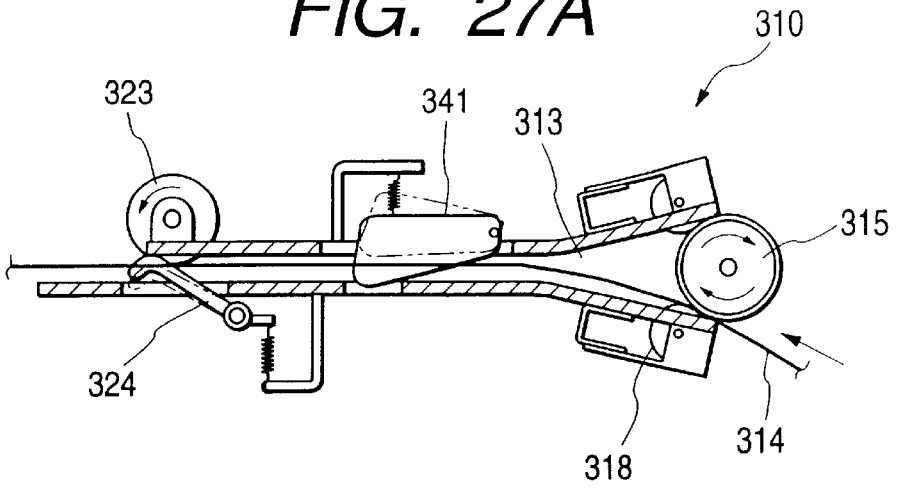
FIG. 27 is a diagram for explaining the inversion operation.

When the leading edge of the sheet 314 to be inverted is reached between the first and the second rollers 315 and 318, the sheet 314 is sandwiched by the rollers 315 and 318, and is fed into the inversion path 313 as is shown in FIG. 27A. The sheet control plate pair 341*a*, 341*b* or 341*c*, which corresponds to the width of the sheet 314, accepts the sheet 314 with positioning both side edges of the sheet 314. In addition, since the sheet 314 runs on to the sheet control plates 341 (the pair 341*a* relative to the pair 341*b*, or the pairs 341*a* and 341*b* relative to the pair 341*c*) that are located at a smaller interval than the width of the sheet 314, the pertinent sheet control plates 341 are retracted against the urging force of the spring 345 to the position where the sheet can be passed by (as indicated by a virtual line in FIG. 27A). Even when the position of the sheet 314 is slightly shifted, the leading edge of the sheet 314 can be accepted by the sheet control plates 341 because the base ends of the sheet control plates 341 are extended outward.

When the leading edge of the sheet 314 is brought into contact with the pressing levers 324, the pressing levers 324 are retracted by the progressing force, and the fourth rollers 324 are slipped, so that the feeding in of the sheet 314 is enabled.

When the trailing edge of the sheet 314 is passed by the first and the second rollers 315 and 318 and the feeding force is no longer exerted to the sheet 314, the trailing edge of the sheet 314 is moved to the third rollers 321 by the feeding force exerted by the outer faces of the first rollers 315. At this time, since the force in the discharge direction is exerted to the sheet 314 by the fourth rollers 323, the trailing edge of the sheet, i.e., the leading edge of the sheet that is inverted (switched back) as is shown in FIG. 27B, is moved through the first and the third rollers 315 and 321, and the sheet 314 is thereafter discharged.

In this discharge process, the position of the sheet 314 is controlled by the sheet control plates 341 that correspond to the width of the sheet 314, so that the sheet 314 is discharged without being skewed. Further, even when the sheet 314 is skewed or shifted in position in the feeding-in process, the skewing or position shifting of the sheet 314 is compensated for (corrected) by the sheet control plates 341 in the inversion process where the feeding force is free for the sheet 314.

As is described above, the sheet control plates 341 can regulate, at a predetermined position, the sheet 314 that is introduced into the inversion path 313. Therefore, even when the sheet 314 is released from the sheet feeding rollers 315 and 318 and is free from the force, or when the discharge rollers 321 exert the force in the discharge direction to the free sheet 314, the sheet 314 is discharged while its position is controlled by the sheet control plates 341. As a result, the skewing of the sheet 314 can be precisely prevented.

FIG. 5 is a diagram illustrating a sheet inversion device 310 according to another embodiment. The same reference numerals are used to denote components that have the same functions as those for the sheet inversion device 310 in the above embodiment as shown in FIGS. 25 to 27B, and no detailed explanation for them will be given.

Figure 27B:
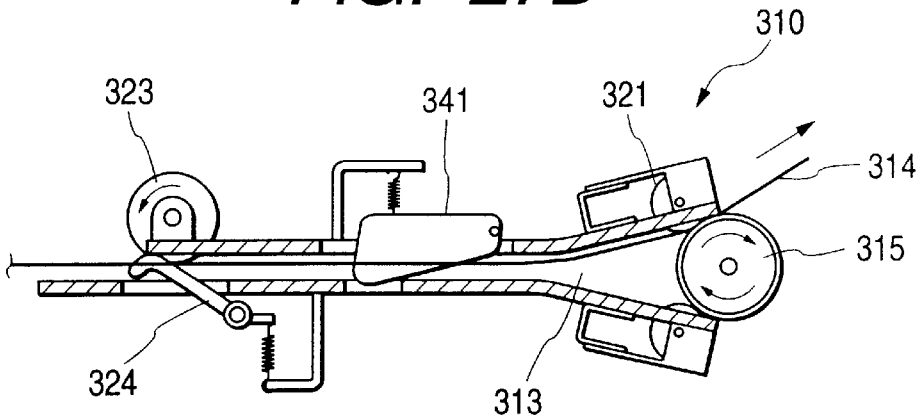

In the embodiment as shown in FIGS. 27A and 27B, the springs 345 that are connected on the free end side and outside the path 313 are employed to maintain the sheet control plates 341 at a position whereat the sheet 314 is controlled. In this embodiment, instead of the springs 345, weights 351 are attached to the outside near the shaft portions 342 of the sheet control plates 341, and the sheet control plates 341 are held in position by the weights 351.

With this arrangement, the same effects are acquired as are obtained when the springs 345 are employed.

FIG. 6 is a diagram illustrating a sheet conversion device 10 according to still another embodiment. The same reference numerals are used to denote components having the same functions as are used for the sheet inversion device 310 in the embodiment as shown in FIGS. 25 to 27B, and no detailed explanation for them will be given.

In the embodiment as shown in FIGS. 25 to 27B, the sheet control plates 341 are individually supported by the bosses 343 of the guide plate 311. In this embodiment, sheet control plate pairs 341*a* and 341*b*, which correspond to the widths of various sheets 314, are respectively coupled with support shafts 352*a* and 352*b*, so that a sheet control plate pair 341*a* or 341*b* can move together. Further, the support shafts 352 and 352*b* are fitted into bosses 343 So they are moveable in the widthwise direction of an inversion path 313.

Also in this embodiment, the sheet control plates 341 are held in position by using the springs 345 or the weights 351.

When the sheet control plates 341 are supported in this manner, the plates 341 can be moved in the widthwise direction of the inversion path 313 within a range that is permitted in accordance with the width of the notch 344. Therefore, even when a thick sheet 314 is fed while it is skewed or its position is shifted, the sheet control plate pair 341 can be moved so as to smoothly accept the sheet 314.

Further, the sheet control plate pair 341 can control the positioning of the sheet 314 it is discharged.

Figure 29:
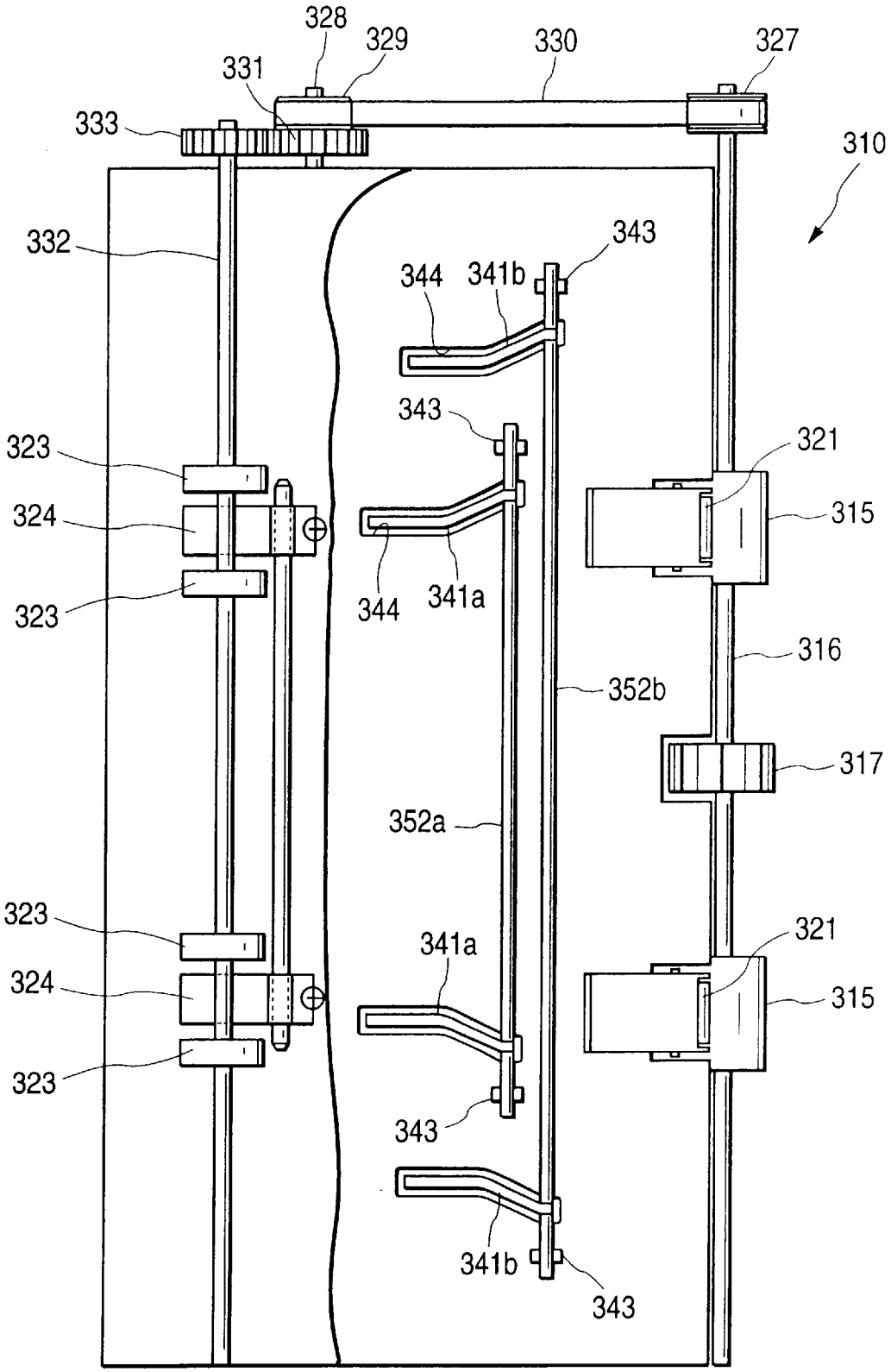
FIG. 29 is a partially cutaway plan view of a sheet inversion device according to still another embodiment.
Figure 30:
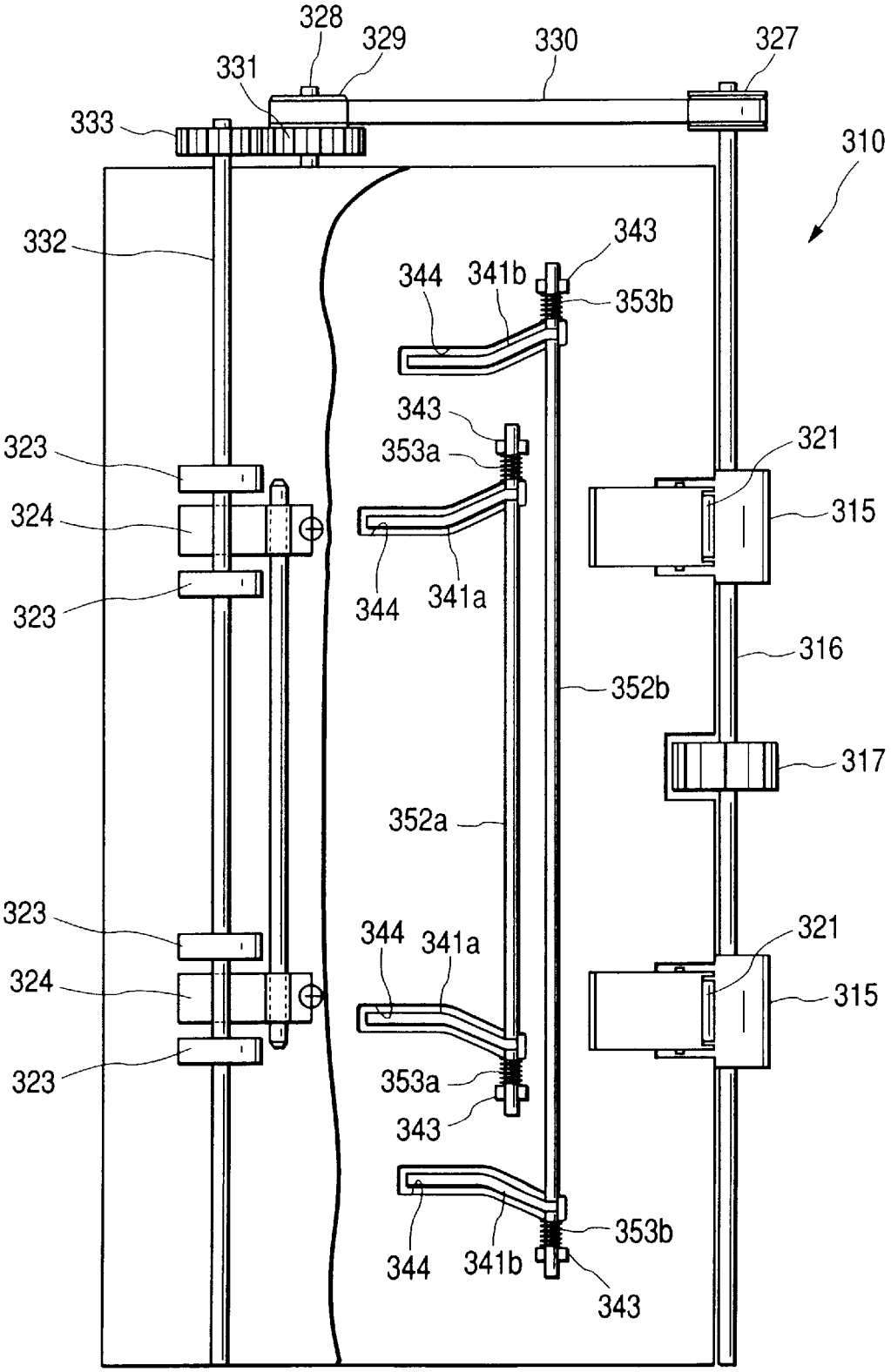
FIG. 30 is a partially cutaway plan view of a sheet inversion device according to still another embodiment.

FIG. 30 is a diagram showing a sheet inversion device 10 according to still another embodiment. The same reference numerals are used to denote components having the same functions as are used for the sheet inversion device 310 in the embodiment in FIG. 29, and no detailed explanation for them will be given.

In this embodiment, the sheet control-plate pairs 341*a* and 341*b* are so provided that they can be moved in the widthwise direction of the inversion path 313. In this embodiment, sheet control plate pairs 341*a* and 341*b* are returned to the center position after they have been moved horizontally.

Specifically, a center control spring 353*a* or 353*b* is located between the outside of each sheet control plate 341 and a boss 343. When the widthwise urging force, which is generated by the feeding force applied to a sheet 314, is not applied to the sheet control plates 341*a* and 341*b*, the free sheet control plate pairs 341*a* and 341*b* are urged (returned) to the center positions by the springs 353*a* and 353*b*.

Therefore, even when a thick sheet 314 that is fed is skewed or its position has been shifted, the sheet control plate pair 341 can be moved and smoothly accept the sheet 314. Further, during the discharge process, the sheet 314 is positioned in the center by the recovery forces exerted by the springs 353*a* and 353*b*, so that the skewing or the shifting of the position of the sheet 314 can be corrected and the sheet 314 discharged.

Figure 31:
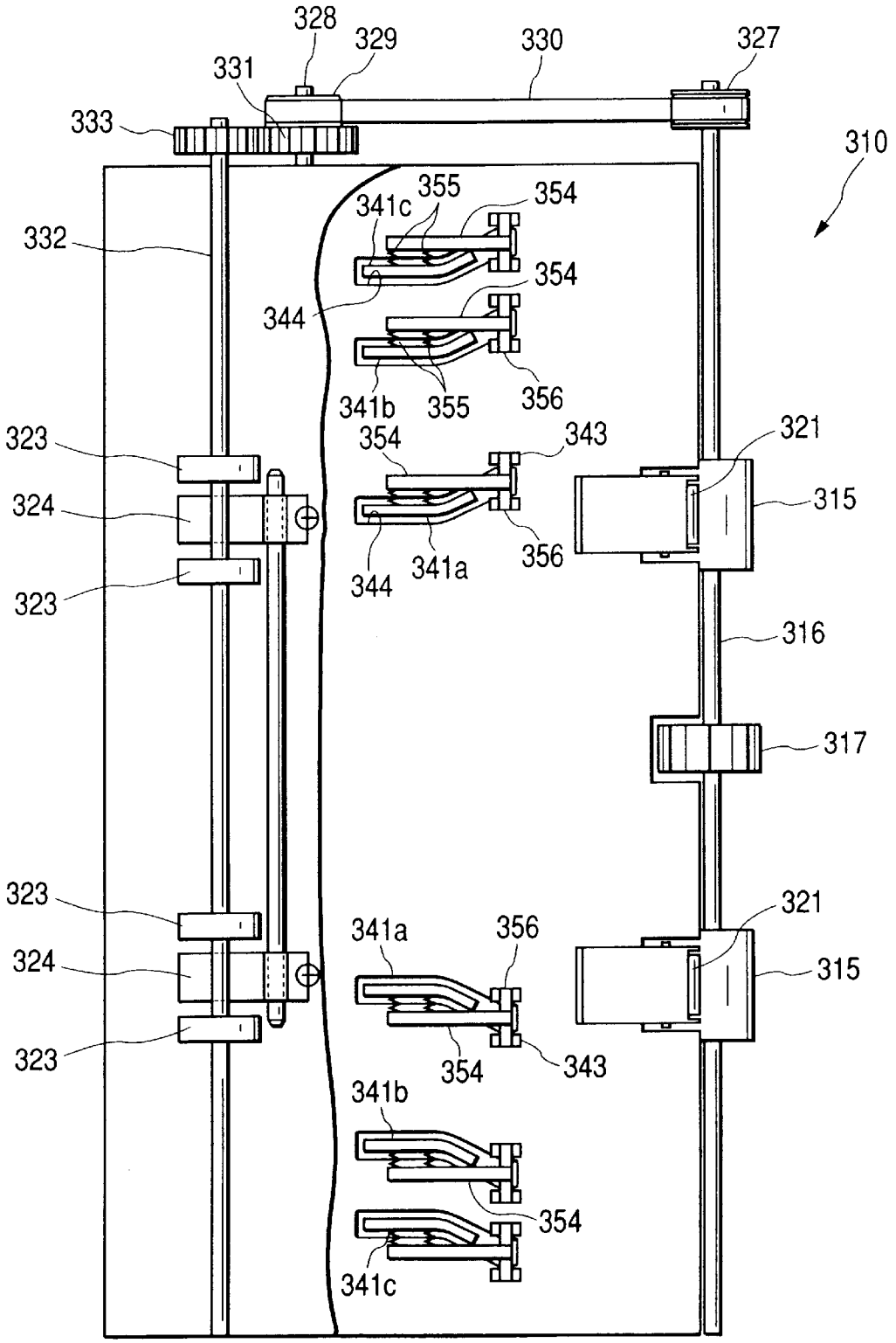
FIG. 31 is a partially cutaway plan view of a sheet inversion device according to still another embodiment.
Figure 32:
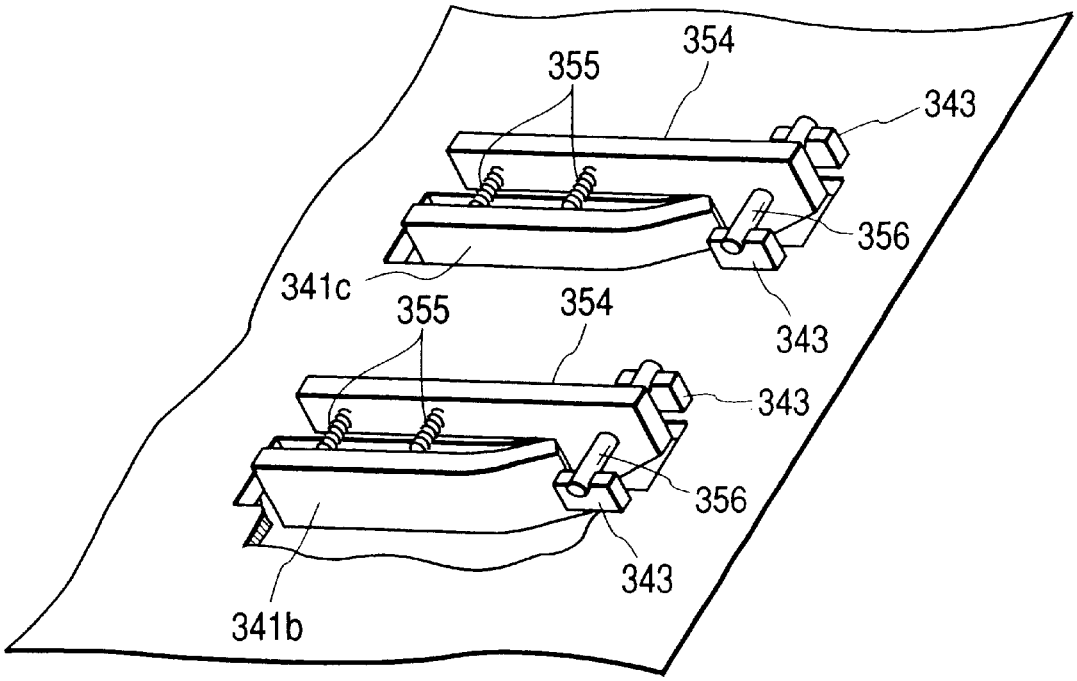
FIG. 32 is a perspective view of the essential portion of FIG. 31.

FIGS. 31 and 32 are diagrams showing a sheet inversion device 310 according to still another embodiment. The same reference numerals are used to denote components having the same functions as are used for the sheet inversion device 310 in the embodiment as shown in FIGS. 25 to 27B, and no detailed explanation for them will be given.

In this embodiment, as can the sheet control plates 341 in this embodiment, sheet control plate pairs 341*a*, 341*b* and 341*c* can be moved horizontally, and can thereafter be returned to the center positions. The structure provided for shifting and recovery differs from that of the embodiment as shown in FIG. 30 and is the feature of this embodiment.

Figure 28:
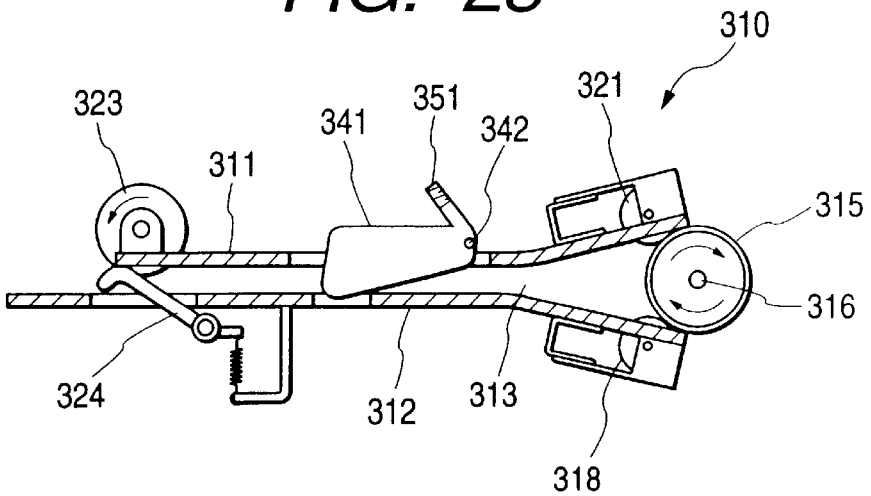
FIG. 28 is a cross-sectional side view of a sheet inversion device according to another embodiment.

Specifically, the sheet control plates 341 in each pair are coupled together by two springs 355 that are positioned before and after a rotation lever 354, and a support shaft 356 at the base end of each rotation lever 354 is fitted into bosses 343 on the guide plate 311. The individual rotation levers 354 are held at constant positions by the springs 345 in FIG. 25 or the weights 51 in FIG. 28.

Further, the sheet control plates 341 are held at predetermined positions by the springs 355 that are located between the plates 341 and the rotation levers 354. When a sheet 314 that is fed is skewed or its position is shifted, the sheet control plates 341 are displaced to accept the sheet 314. Then, when the sheet 314 is freed from the feeding force, it is controlled at the center position by the recovery forces of the springs 355, so that the skewing or the shifting of the position of the sheet 314 can be corrected and the sheet 314 can be discharged.

Figure 33:
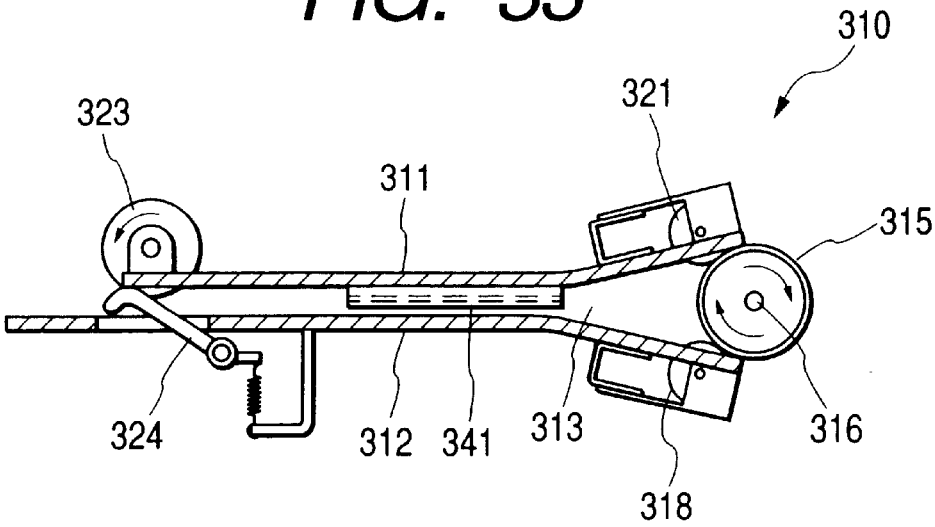
FIG. 33 is a cross-sectional side view of a sheet inversion device according to still another embodiment.
Figure 34:
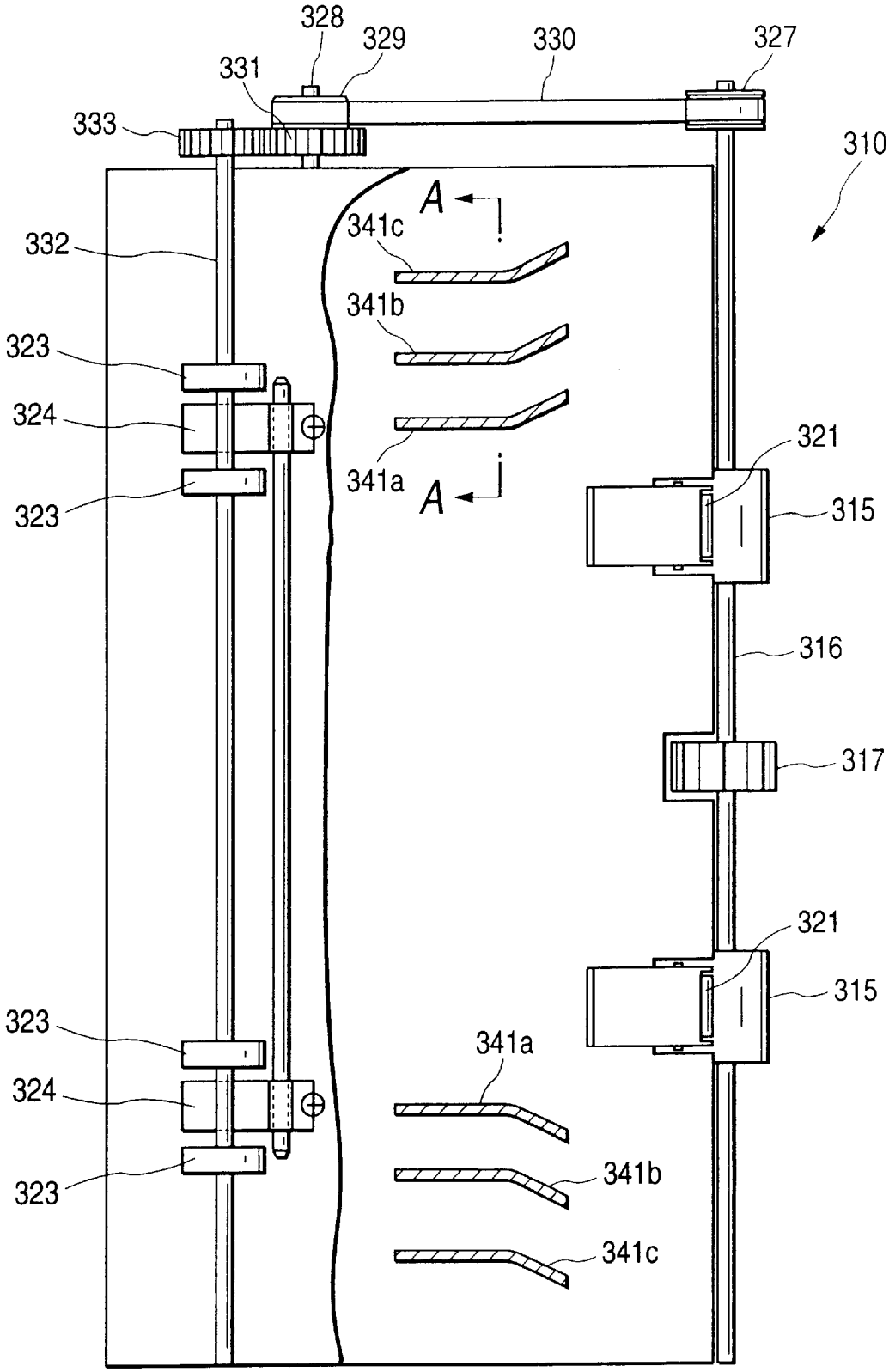
FIG. 34 is a partially cutaway plan view of the sheet inversion device as shown in FIG. 33.
Figure 35:
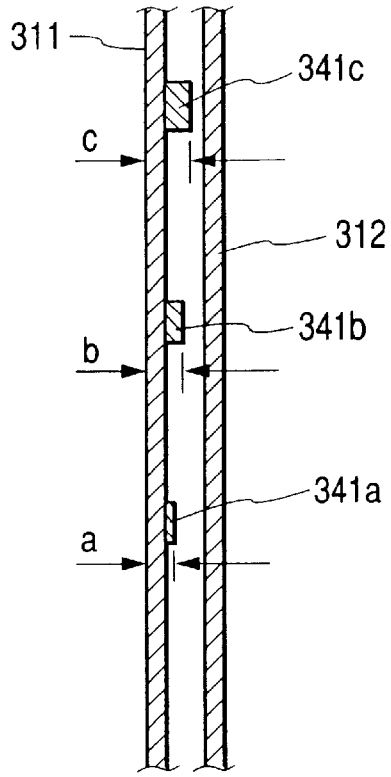
FIG. 35 is a cross-sectional view along line A—A in FIG. 34.

FIGS. 33 to 35 are diagrams showing a sheet inversion device 310 according to still another embodiment. The same reference numerals are used to denote components having the same functions as those for the sheet inversion device 310 in the embodiment as shown in FIGS. 25 to 27B, and no detailed explanation for them will be given.

In this embodiment, sheet control plate pairs 341*a*, 341*b* and 341*c* are assembled in rib-shaped arrangement, and are integrally formed and fixed to a guide plate 311 on the side of an inversion path 313. The height of a sheet control plate pair 341 above the guide plate increases in consonance with and increase in the width of the sheets that are to be handled, i.e., the height of each pair is equivalent to a <b <c (see FIG. 35).

Since the sheet control plate pairs 341*a*, 341*b* and 341*c* are formed in this manner, when a sheet 314 is fed in, the sheet control plate pair 341*a*, 341*b* or 341*c* that corresponds to the width of the sheet 314 accepts the sheet 314, while positioning both side edges of the sheet 314. Further, since the sheet 314 runs across the sheet control plate pair 341 (the pair 341*a* relative to the pair 341*b*, or the pairs 341*a* and 341*b* relative to the pair 341*c*) that corresponds to a narrower sheet 314, the sheet 314 that is fed in can be accepted without any trouble.

In the discharge process, the sheet 314 can be positioned by the sheet control plate pair 341*a*, 341*b* or 341*c* that accepted the sheet 314, and can be discharged.

Figure 36:
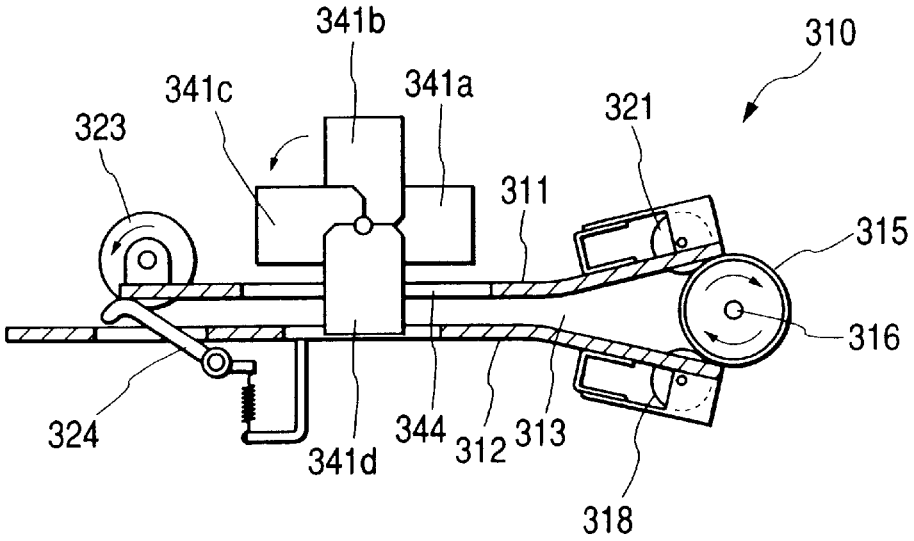
FIG. 36 is a cross-sectional side view of a sheet inversion device according to still another embodiment.
Figure 37:
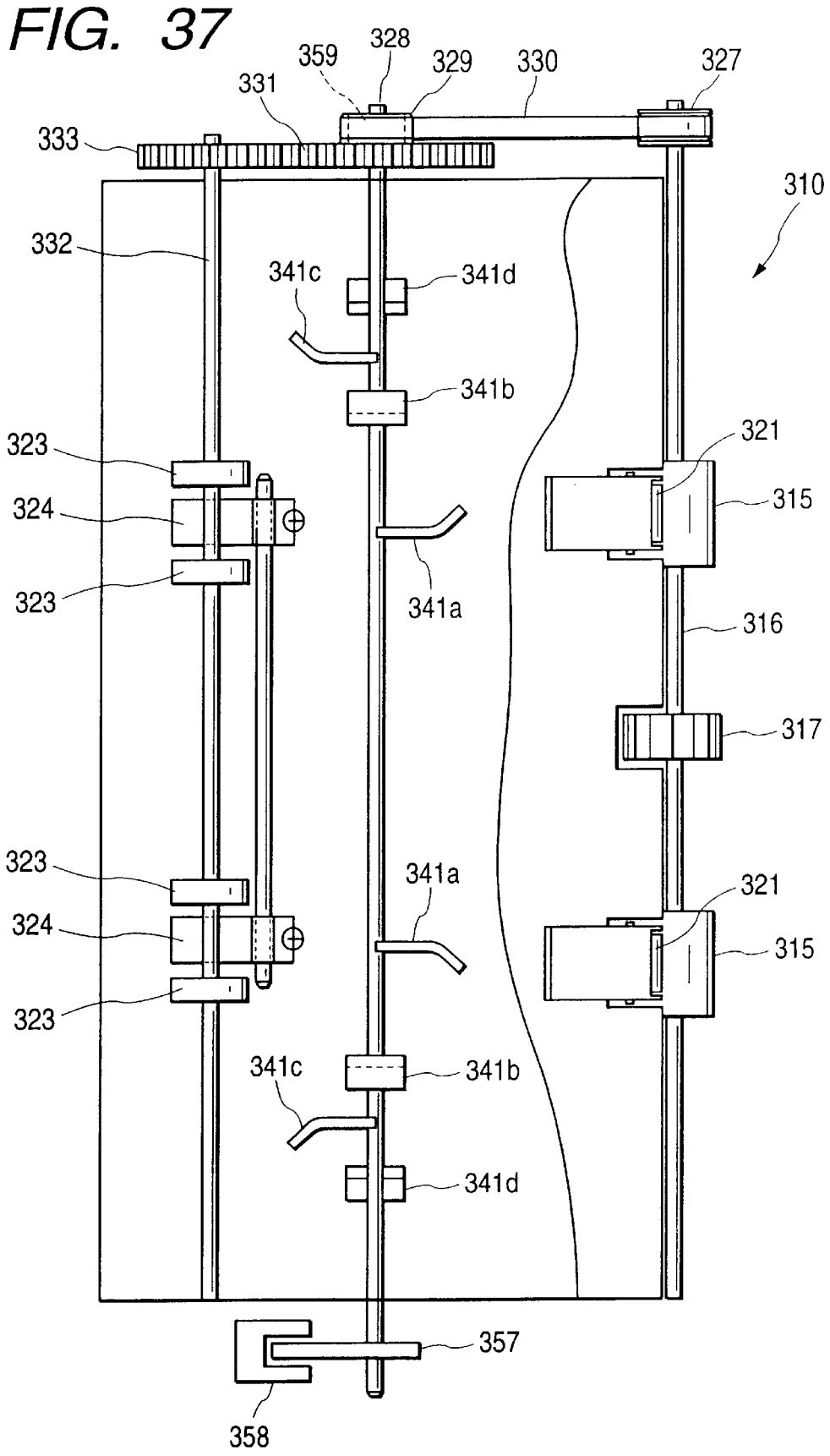
FIG. 37 is a partially cutaway plan view of the sheet inversion device as shown in FIG. 36.

FIGS. 36 and 37 are diagrams showing a sheet inversion device 310 according to still another embodiment. The same reference numerals are used to denote components having the same functions as are used for the sheet inversion device 310 in the embodiment as shown in FIGS. 25 to 27B, and no detailed explanation for them will be given.

In this embodiment, the base ends of sheet control plate pairs 341*a*, 341*b*, 341*c* and 341*d* are securely fitted around an intermediate shaft 328 at a predetermined angle (e.g., 90 degrees). The distal ends of the sheet control plates 341 are exposed through notches 344 at positions where the plates 341 act on a sheet 314.

A detection piece 357 is fixed to the other end of the intermediate shaft 328 to detect the position (home position) that is set by a photoelectric sensor 358. The position of each sheet control plate pair 341 is calculated by using the angle, and the intermediate shaft 328 is rotated. Then, the sheet control plate 341 corresponding to the width of the sheet 314 to be inverted can be selected and exposed along the inversion path 313.

A drive force is transmitted from the rotary shaft 316 of the first rollers 315 to the intermediate shaft 28. However, to invert a sheet 314, the direction of the rotation is the opposite of the rotation of the first rollers 315.

Specifically, a unidirectional clutch 359, to which the reverse rotation of the first rollers 315 is transmitted, is located between a pulley 329 and the intermediate shaft 328. When the normal inversion process is performed, the intermediate shaft 328 is not rotated, and the rotation of the pulley 329 is transmitted to a gear 331 that is coupled (continuously engaged) with the pulley 329, so that the fourth rollers 323 are rotated. When the inversion process is not performed, the intermediate shaft 328 is so controlled that it is rotated reversely. Therefore, the drive source for rotating the rotary shaft 316 of the first rollers 315 is constituted by a pulse motor that enables forward or backward rotation.

With this arrangement, the sheet control plate pair 341 is projected into the inversion path 313, and no other, unnecessary sheet control pair is exposed. Thus, the chance that a sheet 314 will be caught by the unused sheet control plates can be completely eliminated.

Furthermore, since the drive force is transmitted from the rotary shaft 316 of the first rollers 315 to rotate the intermediate shaft 328 in the reverse direction, a special drive source for rotating the intermediate shaft 328 is not required, and the structure can be simplified.

An explanation will now be given for a copier that incorporates the sheet inversion device 310 described above.

Figure 38:
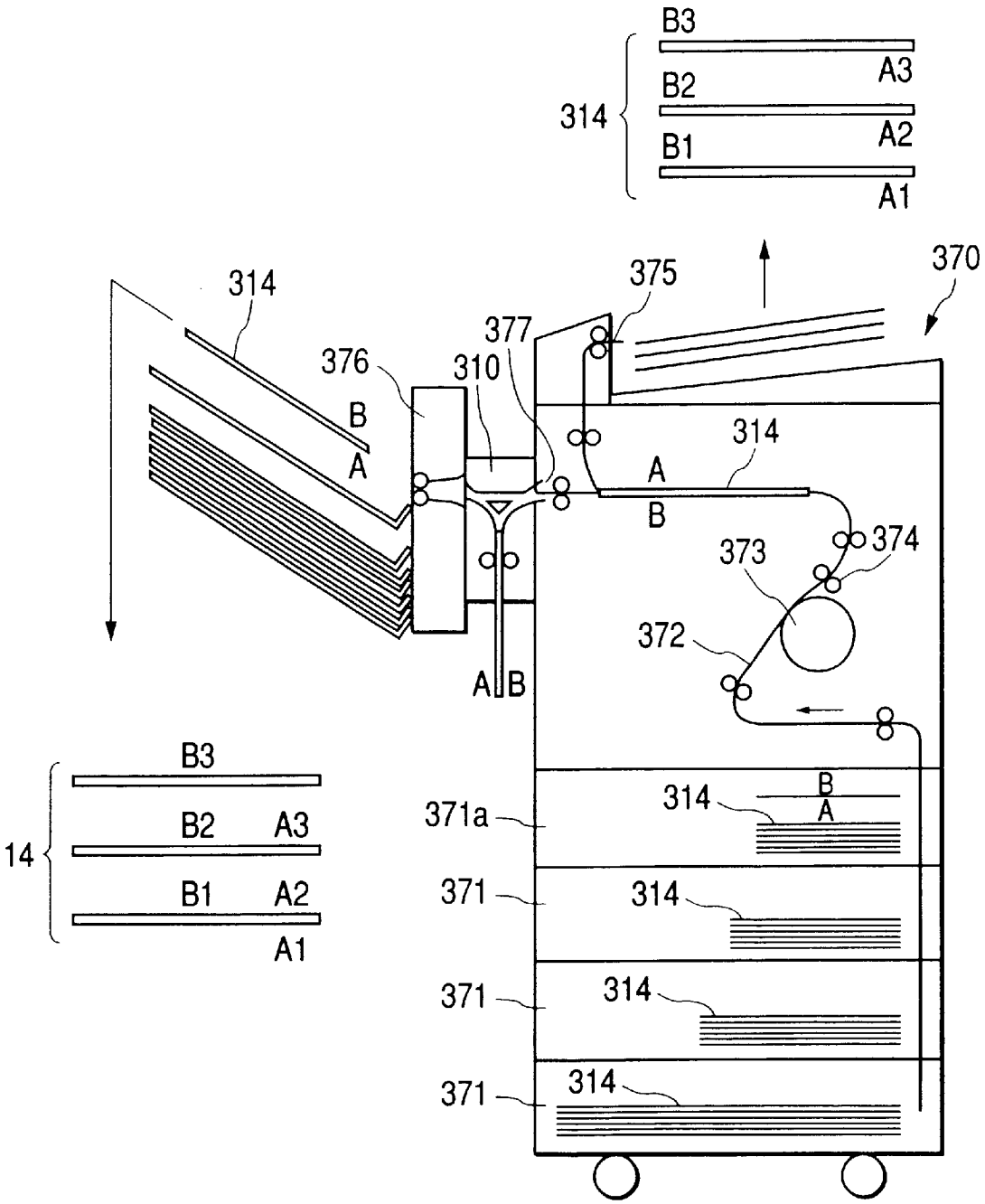
FIG. 38 is a diagram illustrating the arrangement of a copier that incorporates the sheet inversion device of the invention.

FIG. 38 is a diagram showing an example wherein the sheet inversion device 310 is mounted in a copier 370 having a connected sorter 376. The copier 370 includes a plurality of sheet cassettes 371 in the lower portion, and various sizes of sheets 314 are stored in the individual sheet cassettes 371.

A sheet 314 from one of the sheet cassettes 371 is fed along a feeding line 372, and an image is transferred to the sheet 314 by a transfer drum 373. The image is then fixed to the sheet 314 by a fixing device 374, and the image-bearing sheet 314 is normally discharged through an upper discharge port 375. When the sorter 376 is mounted, however, the image-bearing sheet 314 is discharged through a lower discharge port 377.

When, for example, the lower side of one sheet 314 stored in the sheet-cassette 371*a* is defined as A, and the upper side is defined as B, the image is transferred to the side A of the sheet 314.

Then, when the resultant sheet 314 is discharged through the upper discharge port 375, the image-bearing side A is facing down, and the succeeding sheets are stacked in order. That is, the first sheet is discharged with its image-bearing side A1 facing down, and the second sheet is stacked over it with the image-bearing side A2 facing down. Even when multiple sheets are sequentially printed, they are discharged with their image-bearing sides A facing down. When the stacked sheets are facing up, the image-bearing sides are arranged in the ascending order, beginning with the side A1.

However, when a sheet 314 is discharged through the lower discharge port 377, the image-bearing side A is facing up. Therefore, when the sorter 376 is connected directly to the lower discharge port 377, the discharged sheets are stacked in the reverse order. To avoid this problem, the sheet inversion device 310 is provided between the lower discharge port 377 and the sorter 376, and a sheet 314 that is to be discharged is inverted by this sheet inversion device 310, so that the image-bearing side A is facing down. As a result, the sheets can be stacked in accordance with the page numbers.

When the sorter 376 is employed as in the above example, only the sheet inversion device 310 need be employed, so that the discharged sheets 314 can be aligned without being skewed, and can be neatly stapled.

Figure 39:
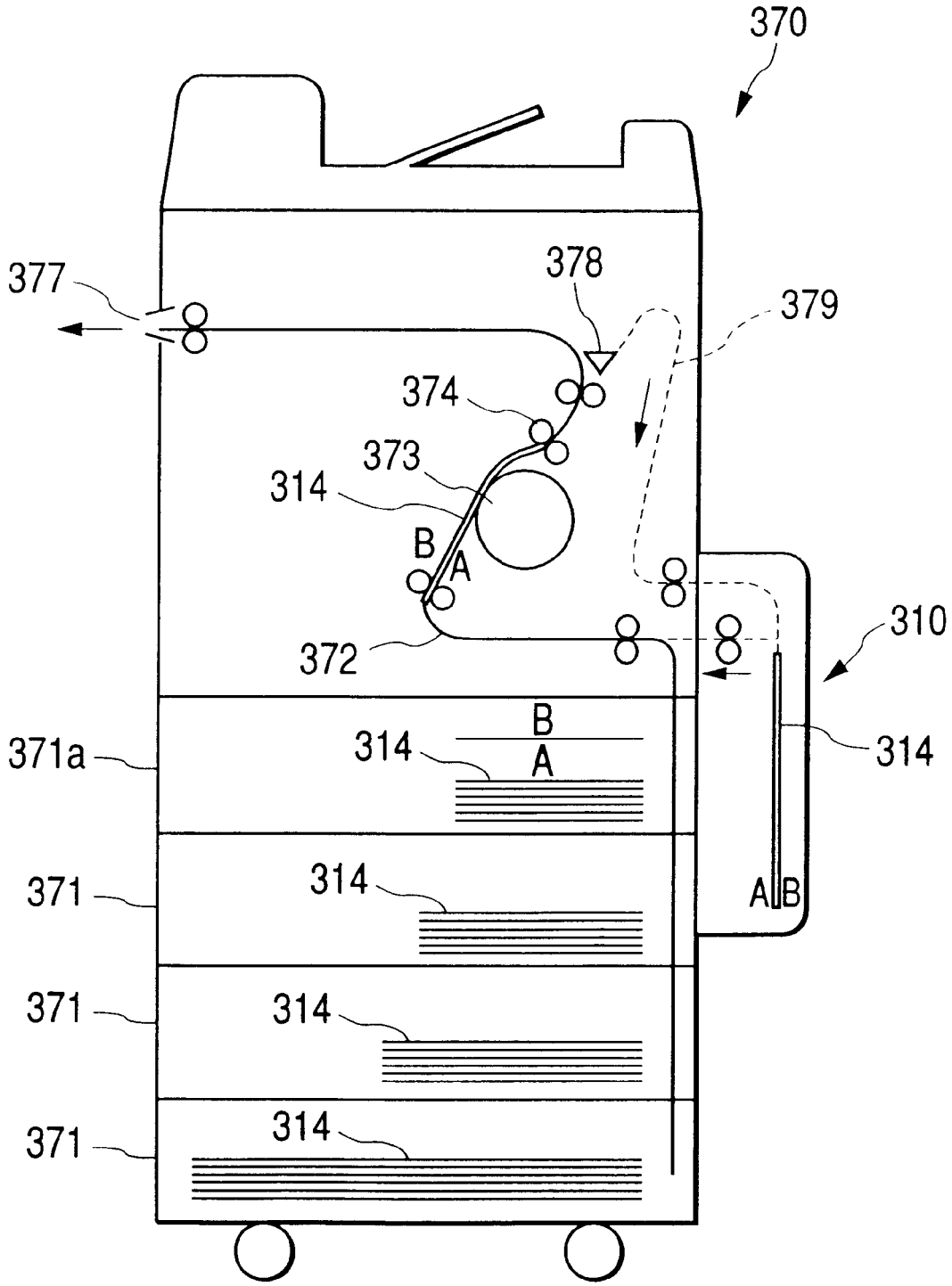
FIG. 39 is a diagram illustrating the arrangement of another copier that incorporates the sheet inversion device of the invention.

FIG. 39 is a diagram showing a double-side copier 370 that incorporates the sheet inversion device 310. The same reference numerals are used to denote components of the copier 370 that correspond to the functions explained while referring to FIG. 38, and no further explanation for them will be given.

In the copier 370, an inverting and feeding line 379 is formed to communicate via a sorting plate 378 with a feeding line 372 that is extended following a fixing device 374. The inverting and feeding line 379 is introduced into the sheet inversion device 310 that is mounted on the external side wall of the copier 370. The sheet 14 that is inverted and discharged by the sheet inversion device 310 is transmitted to a feeding line 372 before a transfer drum 373.

For double-side copying, first, an image is transferred to side A of the sheet 314. The sheet 314 is then introduced into the inverting and feeding line 379 by the sorting plate 378, and is fed into the sheet inversion device 310. When the sheet inversion device 310 inverts the sheet 314 and feeds the inverted sheet 314 to the transfer drum 373, side B of the sheet 314 is located opposite to the transfer drum 373, so that double-side printing is enabled. As is described above, when the sheet inversion device 310 of this invention is employed for double-side printing, the inverted sheet 314 is not skewed, so that satisfactory double-side printing can be performed while the image transfer position is aligned.

The sheet inversion device 310 of this invention can be not only be employed for the copier 370, but also for an image processing apparatus, such as a printer, that requires sheet inversion. Further, in the embodiments, the center line of the sheet 314 is aligned with the center line of the sheet inversion device 310. However, for an image processing apparatus that feeds a sheet 314 using only one side edge of the sheet 314 as a reference, the sheet control plates 341 may be provided for the one side that corresponds to the side edge used by the apparatus.

The correlation between the structure of the invention and the embodiments is as follows:

the urging unit of the second aspect corresponds to the springs 355 in FIGS. 31 and 32; and the urging unit of the fourth aspect corresponds to the springs 353*a* and 353*b* in FIG. 30. However, this invention is not limited to the structures described in the above embodiments, and can be applied for other structures based on the technical ideas described in the claims.

What is claimed is:

1. A sheet inversion device for reversing the surfaces of a sheet that has been fed into said sheet inversion device, comprising:

a first roller, located at the start of an inversion path in the direction in which a sheet is input or output along said inversion path, that rotates in only one direction;

a second roller, arranged parallel to said first rollers, that rotates with said first roller so as to feed said sheet into said inversion path;

a third roller, located in parallel to said first rollers on the opposite side of said first rollers from said second rollers, that rotates with said first rollers to feed out and discharge said sheet from said inversion path;

a fourth roller, located inside said inversion path, for applying a feeding force, in a discharge direction relative to a sheet feeding force applied by said first and second rollers, that causes said fourth rollers to slip across said sheet; and a pressing and guide member, for applying, with said fourth roller, a sheet pressing force that resists the advance of a sheet that is being fed;

wherein a pressing face of said pressing and guide member has the same arced shape as has the circumferential outer face of said fourth roller.

2. A sheet inversion device according to claim 1, wherein said pressing guide member comprises a first member for applying a pressing force and a second member having the same shape as the outer-circumferential face of said fourth roller; and wherein said second member is permitted to pivot in the feeding direction at a fulcrum position whereat said second member is supported by said first member.

3. A sheet inversion device according to claim 2, wherein an intermediate portion of said second member in located at said fulcrum position, and an elastic member for adjusting a pivoting distance is employed to couple together said first member and the rear portion of said second member.

* * * * *